US006366247B1

(12) United States Patent
Sawamura et al.

(10) Patent No.: US 6,366,247 B1
(45) **Date of Patent: *Apr. 2, 2002**

(54) ANTENNA DEVICE AND PORTABLE RADIO SET

(75) Inventors: Masatoshi Sawamura, Saitama; Hiroki Ito, Tokyo, both of (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/633,662

(22) Filed: Aug. 7, 2000

(30) Foreign Application Priority Data

Aug. 6, 1999 (JP) ..... 11-224264

(51) Int. Cl.[7] ..... H01Q 1/24; H01Q 1/36
(52) U.S. Cl. ..... 343/702; 343/895; 343/725
(58) Field of Search ..... 343/702, 895, 343/725, 729, 850, 853, 852, 859, 860, 865; H01Q 1/24, 1/36

(56) References Cited

U.S. PATENT DOCUMENTS 6,075,488 A * 6/2000 Hope ..... 343/702
6,097,341 A * 8/2000 Saito ..... 343/702
6,097,349 A * 8/2000 Sanford ..... 343/859

* cited by examiner

*Primary Examiner*—Hoanganh Le
(74) *Attorney, Agent, or Firm*—Jay H. Maioli

(57) ABSTRACT

The present invention makes it possible to realize an antenna device and a portable radio set capable of greatly reducing the deterioration of antenna characteristics while used near a human body and greatly reducing the deterioration of communication quality by electrically connecting first and second antenna elements to a balanced-to-unbalanced transform circuit by connection means when a first antenna element is retracted, supplying power to the first and second antenna elements from an unbalanced transmission line through balanced-to-unbalanced transform means to operate the first and second antenna elements as antennas, preventing a leakage current from flowing to a ground member to which the unbalanced transmission line is grounded from the first and second antenna elements through the transmission in accordance with the balanced-to-unbalanceed transform by the balanced-to-unbalanced transform means, and thereby preventing the ground member from operating as an antenna.

12 Claims, 44 Drawing Sheets

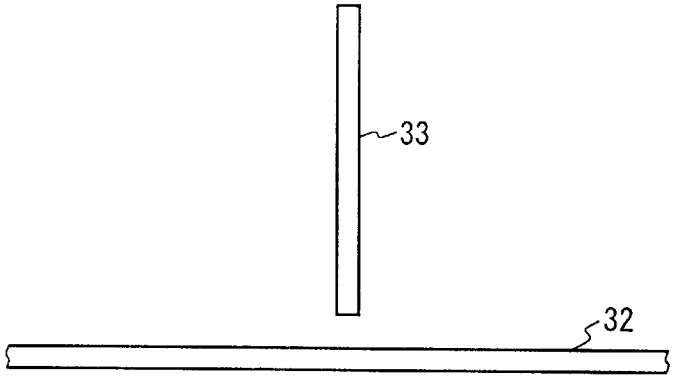
FIG. 5
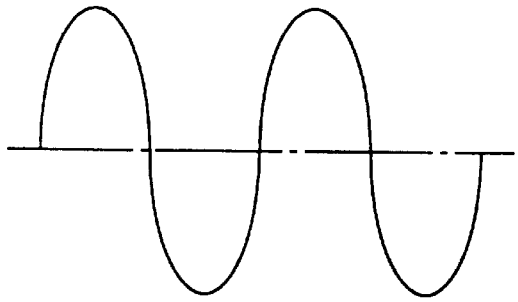
FIG. 6A
FIG. 6B

ANTENNA DEVICE AND PORTABLE RADIO SET

BACKGROUND OF THE INVENTION

1. Field of the Invention

The present invention relates to an antenna device and a portable radio set, and more particularly, is suitably applied to a cellular telephone.

2. Description of the Related Art

The cellular telephone of this type has been decreased in size and weight so far in order to improve the portability. Thereby, a retract/pull-out type of whip antenna device is positively developed as an antenna device provided for a cellular telephone. There is a cellular telephone configured as shown in FIGS. 1A and 1B as the cellular telephone of the above type.

In case of a cellular telephone 1 having the above configuration, a whip antenna device 3 is providing for in a housing 2 made of a nonconductive material such as synthetic resin.

The antenna device 3 has an antenna section 6 provided with a rod antenna 4 made of a conductive wire rod and a helical antenna 5 formed by helically winding a conductive wire rod. The antenna section is set so as to be freely retracted and pulled out along a direction in which the antenna section 6 is pushed into the housing 2 shown by an arrow a at the upper end 2A of the housing 2 (this direction is hereafter referred to as retracting direction) and inversely, along a direction in which the section 6 is pulled out of the housing 2 (this direction is hereafter referred to as pull-out direction).

In the antenna section 6, a first power-supply member 7 made of a conductive material and having a protrusion 7A is electrically and mechanically connected to the lower end of the rod antenna 4 and a joint 8 made of a nonconductive material is mechanically connected to the upper end of the rod antenna 4.

Moreover, a second power-supply member 9 made of a conductive material is electrically and mechanically connected to the lower end of the helical antenna 5 and mechanically connected to the joint 8. Thereby, in the antenna section 6, the rod antenna 4 and the helical antenna 5 are mechanically connected each other by the joint 8 but they are electrically separated from each other.

Moreover, the rod antenna 4 is covered with a rod antenna cover 10 and the helical antenna 5 is stored in a cap-shaped helical antenna cover 11 so that the antennas 4 and 5 do not directly contact a user.

A circuit board (not illustrated) on which various circuit devices including a transceiving circuit 12 and a matching circuit 13 are mounted and a shielding case serving as a ground member made of a conductive material for covering the circuit board are stored in the housing 2.

Moreover, an antenna power-supply terminal 14 made of a conductive material electrically connected to the matching circuit 13 is set inside of the upper end 2A of the housing 2 and only either of the rod antenna 4 and helical antenna 5 is electrically connected to the antenna power-supply terminal 14 when the antenna section 6 is retracted or pulled out.

Actually, in the antenna device 3, the antenna section 6 is pushed in and the helical antenna cover 11 is pushed in the retracting direction and made to contact the upper end 2A of the housing 2 to push the rod antenna 4 into the housing 2 and store the rod antenna 4 in the housing 2 and electrically connect the second power-supply member 9 to the antenna power-supply terminal 14.

Moreover in the antenna device 3, power is supplied to the helical antenna 5 from the transceiving circuit 12 through the matching circuit 13, antenna power-supply terminal 14, and second power-supply member 9 in order under the above state to make the helical antenna 5 operate as an antenna.

Furthermore, in the antenna device 3, by electrically separating the rod antenna 4 from the antenna power-supply terminal 14 by the joint 8, the rod antenna 4 is not operated as an antenna.

In the antenna device 3, however, when the second antenna cover 11 is pulled in the pull-out direction while the rod antenna 4 is stored in the housing 2, the rod antenna 4 is pulled out to the outside from the upper end 2A of the housing 2, the protrusion 7A of the first power-supply member 7 is made to contact the antenna power-supply terminal 14, and thereby the first power-supply member 7 is electrically connected to the antenna power-supply terminal 14.

Furthermore, in the antenna device 3, power is supplied to the rod antenna 4 from the transceiving circuit 12 through the matching circuit 13, antenna power-supply terminal 14, and first power-supply member 7 in order under the above state to make the rod antenna 4 operate as an antenna.

Furthermore, in the antenna device 3, by electrically separating the helical antenna 5 from the antenna power-supply terminal 14 by the joint 8, the antenna 5 is not operated as an antenna.

In this connection, to make the rod antenna 4 and helical antenna 5 operate as antennas, the impedances of the rod antenna 4 and helical antenna 5 are matched with the impedance of the unbalanced transmission line 16 by the matching circuit 13.

Moreover, the shielding case functions as ground for various circuit devices and moreover functions as an electrical shielding plate for preventing radio waves of external noise and radio waves emitted from the antenna section 6 from entering various circuit devices mounted on a circuit board.

Thereby, the cellular telephone 1 makes it possible to, at the time of pulling out the antenna section 6, transmit a transmission signal configured of a high-frequency signal from the transceiving circuit 12 to the rod antenna 4 through the matching circuit 13, transmit the transmission signal to a base station (not illustrated) through the rod antenna 4, and transmit a reception signal configured of a high-frequency signal transmitted from the base station and received by the rod antenna 4 to the transceiving circuit 12 through the matching circuit 13.

Moreover, the cellular telephone 1 makes it possible to prevent damage to the rod antenna 4 by storing the antenna 4 in the housing 2 at the time of retracting the antenna section 6, transmitting a transmission signal from the transceiving circuit 12 to the helical antenna 5 through the matching circuit 13 under the above state, transmitting the transmission signal to a base station through the helical antenna 5, and transmitting a reception signal transmitted from the base station and received by the helical antenna 5 to the transceiving circuit 12 through the matching circuit 13.

The cellular telephone 1 having the above configuration is provided with an unbalanced transmission line 26 configured of a microstrip line formed on a circuit board, in which the rod antenna 4 or helical antenna 5 is electrically connected to the transceiving circuit 12 through the hot side of the unbalanced transmission line 26 and the matching circuit 13 sequentially, and the ground side of the unbalanced transmission line 26 is grounded to the shielding case.

Then, in the cellular telephone 1, as shown in FIGS. 2A and 2B, when power is supplied to the rod antenna 4 and helical antenna 5 through the hot side of the unbalanced transmission line 26 to operate the rod antenna 4 and helical antenna 5 as antennas, a leakage current i1 flows to the shielding case 27 having a potential almost equal to that of the ground side of the unbalanced transmission line 26 from the ground side and thereby, the shielding case 27 also operates as an antenna.

Therefore, in the cellular telephone 1, when the shielding case 27 operates as an antenna and the housing 2 is held by a hand of a user or when the housing 2 is approached to the head of the user, antenna characteristics of the cellular telephone 1 are deteriorated because the shielding case 27 approaches a hand or the head of the user through the housing 2.

When the antenna section 6 is pulled out, the physical length of the rod antenna 4 pulled out from the upper face 2A of the housing 2 is comparatively large and it is possible to separate the rod antenna 4 from a hand of a user holding the housing 2 or the head of the user to which the housing 2 is approached. Therefore, deterioration of antenna characteristics of the cellular telephone 1 is almost caused by the shielding case 27 approached to a user.

However, when the antenna section 6 is retracted, the physical length of the helical antenna 5 protruded beyond the upper face 2A of the housing 2 is very small as compared with the case of the pulled-out rod antenna 4 and the helical antenna 5 greatly approaches a hand of the user holding the housing 2 or the head of the user to which the housing 2 is approached together with the shielding case 27. Therefore, antenna characteristics of the cellular telephone 1 are extremely deteriorated compared to the case in which the antenna s;section 6 is pulled out and as a result, a problem occurs that communication quality is deteriorated.

Moreover, the cellular telephone 1 has a problem that when the antenna section 6 is retracted, the shielding case 27 and helical antenna 5 are made to approach a hand or the head of a user and thereby, the power for unit time or unit mass absorbed in a specific portion of a user {so-called Specific Absorption Rate (SAR)) is increased.

SUMMARY OF THE INVENTION

In view of the foregoing, an object of the invention is to provide an antenna device and a portable radio set capable of greatly reducing the deterioration of communication quality when an antenna element is retracted.

The foregoing object and other objects of the invention have been achieved by the provision of an antenna device comprising a first antenna element provided so as to be freely retracted or pulled out, a second antenna element, an unbalanced transmission line for supplying power to the first and second antenna elements, balanced-to-unbalanced transform means for performing balanced-to-unbalanced transform between the unbalanced transmission line on one hand and the first and second antenna elements on the other, and connection means for electrically connecting the first and second antenna elements to the balanced-to-unbalanced transform circuit when the first antenna element is retracted and electrically connecting at least the first antenna element to the balanced-to-unbalanced transform circuit when the first antenna element is pulled out, in which power is supplied to the first and second antenna elements from the unbalanced transmission line through the balanced-to-unbalanced transform means so as to operate the first and second antenna elements as antennas when the first antenna element is retracted and power is supplied to at least the first antenna element from the unbalanced transmission line through the balanced-to-unbalanced transform means to operate the first antenna element as an antenna when the first antenna element is pulled out.

As a result, when the first antenna element is retracted, it is possible to prevent a leakage current from flowing through a ground member to which the unbalanced transmission line is grounded from the first or second antenna element through the unbalanced transmission line due to balanced-to-unbalanced transform by the balanced-to-unbalanced transform means, thereby preventing the ground member from operating as an antenna, and greatly reducing the deterioration of antenna characteristics near a human body.

Moreover, the present invention provides a portable radio set having an antenna device comprising a first antenna element provided so as to be freely retracted and pulled out, a second antenna element, an unbalanced transmission line for supplying power to the first and second antenna elements, balanced-to-unbalanced transform means for performing balanced-to-unbalanced transform between the unbalanced transmission line on one hand and the first and second antenna elements on the other, and connection means for electrically connecting the first and second antenna elements to the balanced-to-unbalanced transform circuit when the first antenna element is retracted and electrically connecting at least first antenna element to the balanced-to-unbalanced transform circuit when the first antenna element is pulled out, in which power is supplied to the first and second antenna elements from the unbalanced transmission line through the balanced-to-unbalanced transform means when the first antenna element is retracted to operate the first and second antenna elements as antennas and power is supplied to at least the first antenna element from the unbalanced transmission line through the balanced-to-unbalanced transform means when the first antenna element is pulled out to operate the first antenna element as an antenna.

As a result, when the first antenna element is retracted, it is possible to prevent a leakage current from flowing through a ground member to which the unbalanced transmission line is grounded from the first or second antenna element through the unbalanced transmission line due to balanced-to-unbalanced transform by the balanced-to-unbalanced transform means, and thereby, prevent the grounding member from operating as an antenna and greatly reduce the deterioration of antenna characteristics nearby a human body.

The nature, principle and utility of the invention will become more apparent from the following detailed description when read in conjunction with the accompanying drawings in which like parts are designated by like reference numerals or characters.

BRIEF DESCRIPTION OF THE DRAWINGS

In the accompanying drawings:

FIG. 5 is a schematic diagram showing the configuration of an unbalanced antenna;

FIGS. 6A and 6B are schematic voltage-waveform diagrams for explaining operations of an unbalanced antenna;

DETAILED DESCRIPTION OF THE EMBODIMENT

Preferred embodiments of this invention will be described with reference to the accompanying drawings:

(1) Theory

Figure 3:
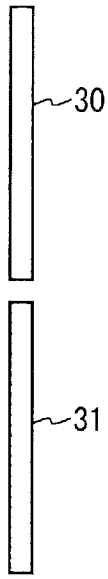
FIG. 3 is a schematic view showing the configuration of a balanced antenna.
Figure 4A:
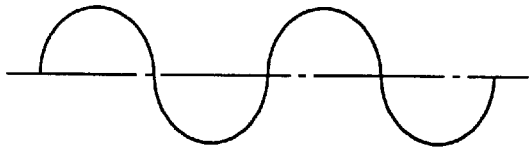
FIGS. 4A and 4B are schematic voltage-waveform diagrams for explaining operations of a balanced antenna.
Figure 4B:
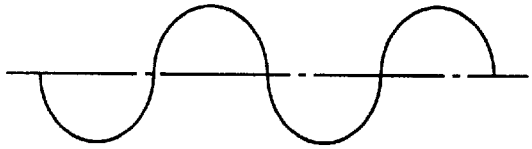

An antenna configured by first and second antenna elements 30 and 31 which are structurally and electrically symmetric like a dipole antenna as shown in FIG. 3 is classified as a balanced antenna because the antenna has the same amplitude in the first and second antenna elements 30 and 31 as shown in FIGS. 4A and 4B and takes a balanced exciting attitude and operates when voltages with phases shifted from each other by an approximately 180° are generated.

Moreover, as shown in FIG. 5, like a monopole antenna almost vertically set to a ground member which can be regarded to be wider than a disk having a radius of one wavelength (electrical length) and to have an infinite size, a structure configured of a ground member 32 which can be regarded to be structurally asymmetric and have an infinite size and an antenna 33 set almost vertically to the member 32 takes an unbalanced exciting attitude because the vast ground member 32 becomes almost zero potential and a voltage changing at a predetermined cycle is generated in the antenna 33 and thereby, the antenna operates as shown in FIGS. 6A and 6B.

In this connection, because the unbalanced antenna has a vast ground member 32, it is possible to easily estimate an image current flowing through the unbalanced antenna and select antenna characteristics of the unbalanced antenna almost similarly to a balanced antenna.

Figure 1A:
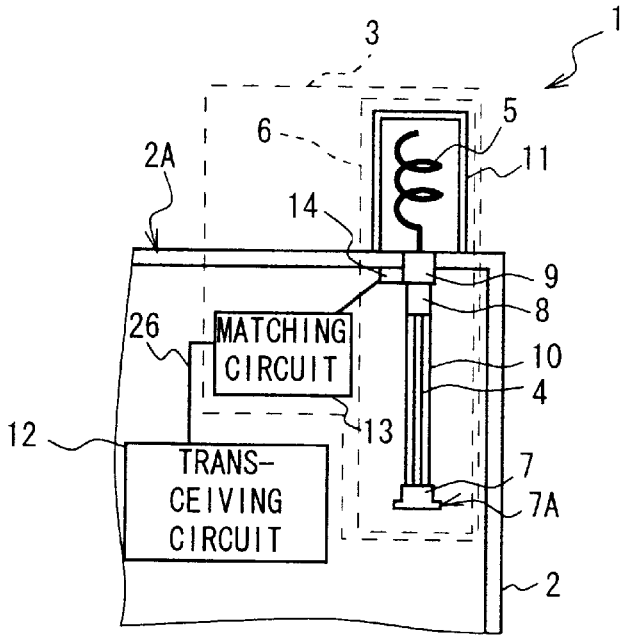
FIG. 1A (PRIOR ART)
FIGS. 1A and 1B are block diagrams showing the circuit configuration of a conventional cellular telephone.
Figure 1B:
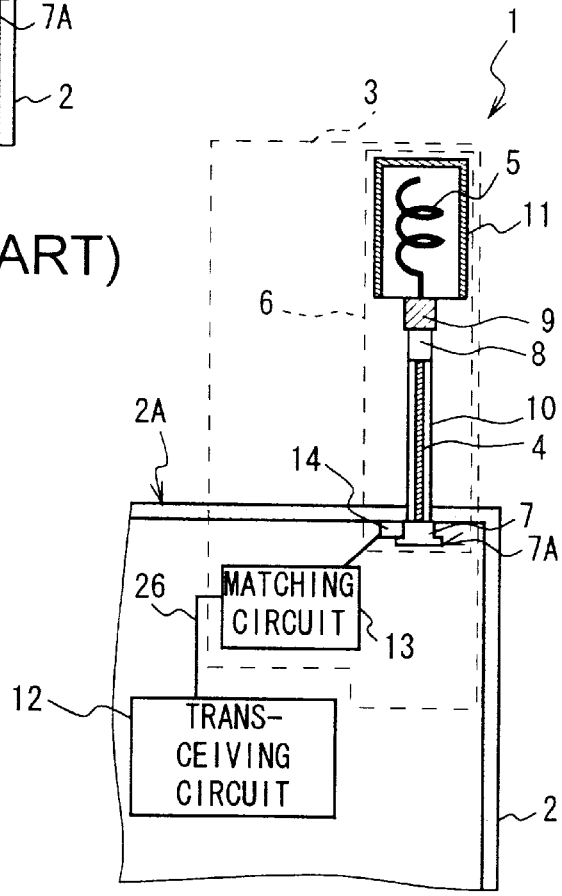
FIG. 1B (PRIOR ART)
Figure 2A:
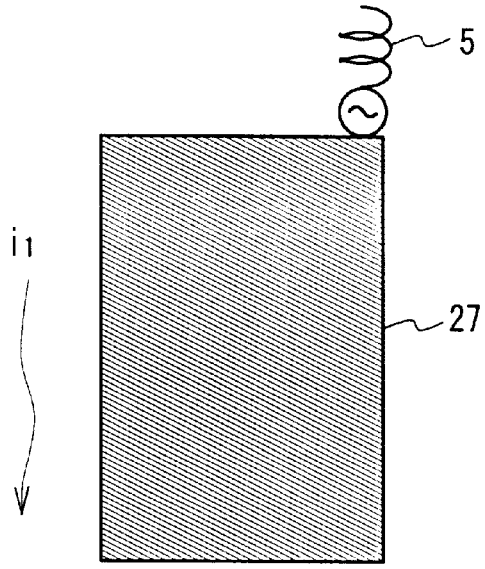
FIG. 2A (PRIOR ART)
FIGS. 2A and 2B are schematic front views for explaining operations of a conventional shielding case serving as an antenna.
Figure 2B:
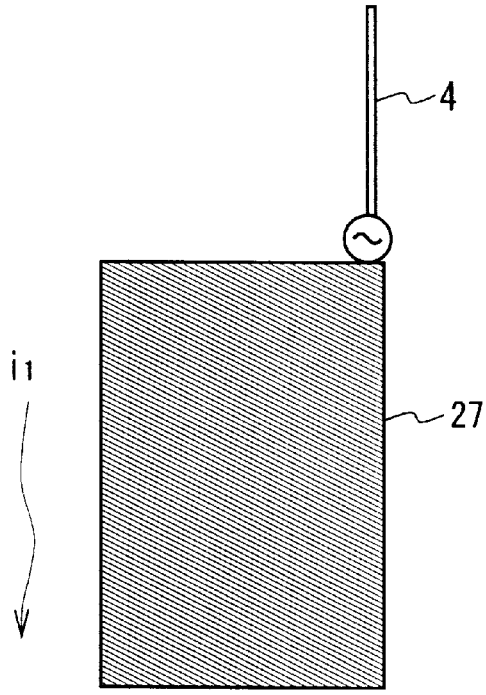
FIG. 2B (PRIOR ART)
Figure 7:
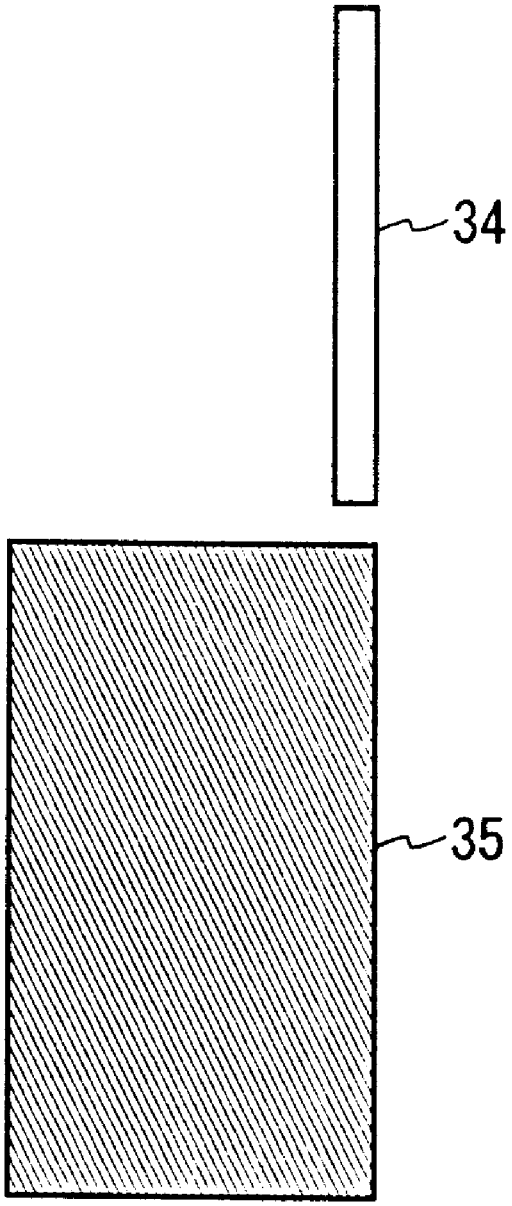
FIG. 7 is a schematic diagram showing the configuration of an intermediate-exciting-attitude antenna.

Moreover, as shown in FIG. 7, as the antenna of this type, an antenna is also used which is configured by structurally and electrically asymmetric first and second antenna elements 34 and 35 similarly to the case of the rod antenna 4 {FIGS. 1A and 1B}, helical antenna 5 {FIGS. 1A and 1B}, and a shielding case 27 {FIGS. 2A to 2C} shown in the conventional cellular telephone 1 {FIGS. 1A and 1B}.

Figure 8A:
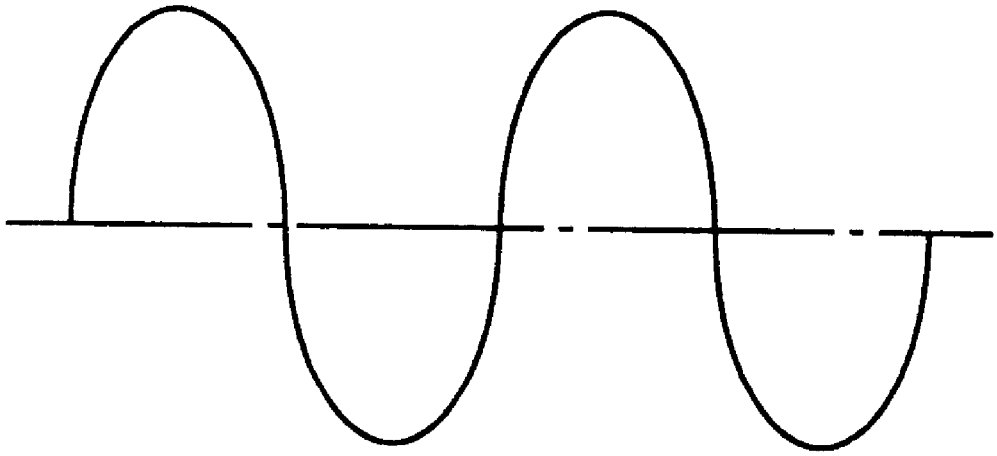
FIGS. 8A and 8B are schematic voltage-waveform diagrams for explaining an operation of an intermediate-exciting-attitude antenna.
Figure 8B:
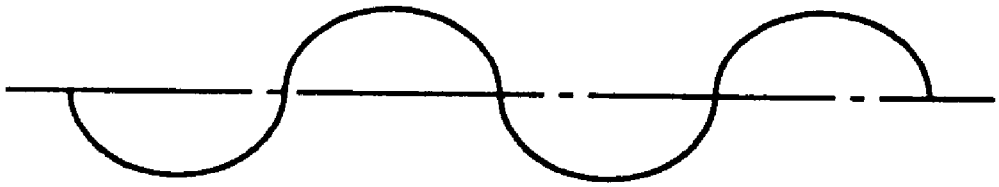

Because the antenna having the above configuration is structurally and electrically asymmetric, it takes an intermediate exciting attitude different from the balanced exciting attitude or unbalanced exciting attitude as shown in FIGS. 8A and 8B. Therefore, the antenna is classified as an antenna (hereafter referred to as intermediate-exciting-attitude antenna) different from a balanced antenna or unbalanced antenna.

Moreover, FIG. 9 shows a cellular telephone 36 of the present invention excluding a matching circuit. In the cellular telephone 36, a housing 37 is provided with a retract/pull-out type antenna device 40 having a rod antenna 38 and a helical antenna 39 serving as first and second antenna elements.

The rod antenna 38 and helical antenna 39 constitute an antenna (hereafter referred to as almost-balanced antenna) taking an almost-balanced exciting attitude, which is electrically symmetric because it is selected to almost the same electrical length though it is structurally asymmetric.

In this connection, in the present invention, an antenna provided for an antenna device is classified as an almost-balanced antenna by taking a balanced exciting attitude because it is electrically symmetric though it is structurally asymmetric unless otherwise specified.

FIG. 7A shows the rod antenna 38 when retracted in which only the helical antenna 39 is protruded beyond the housing 37, the rod antenna 38 in the housing 37 can be used as a transceiving antenna element together with the helical antenna 39. And FIG. 7B shows the rod antenna 38 when pulled out in which only the rod antenna 38 can be used as a transceiving antenna element by protruding the rod antenna 38 beyond the housing 37.

Actually, the antenna device 40 is provided with an unbalanced transmission line 42 configured of a microstrip line, the rod antenna 38 and helical antenna 39 are electrically connected to the transceiving circuit 41 through the unbalanced transmission line 42 or only the rod antenna 38 is electrically connected to the transceiving circuit 41.

Figure 10:
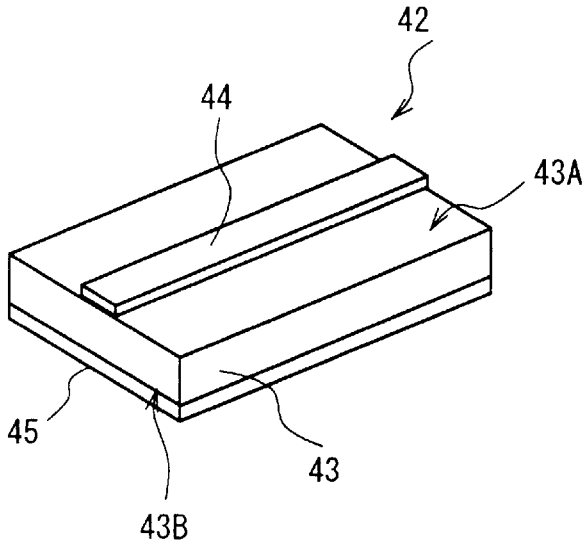
FIG. 10 is a schematic perspective view showing the configuration of an unbalanced transmission line configured by a microstrip line.

In this case, FIG. 10 shows a microstrip line applied as the unbalanced transmission line 42, which is configured by providing a strip conductor 44 for one face 43A of a dielectric layer 43 having a predetermined thickness as a hot side and providing an earth conductor 45 for the other face 43B of the dielectric layer 43 as a ground side and, for example, formed on a circuit board (not illustrated) stored in the housing 37.

Figure 11:
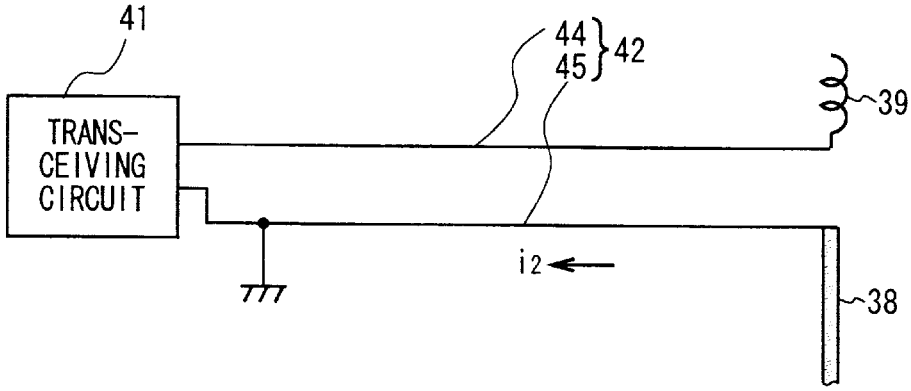
FIG. 11 is a schematic block diagram for explaining the connection between an unbalanced transmission line on one hand and rod antenna and helical antenna on the other.

Moreover, in case of the antenna device 40, as shown in FIG. 11, at the time of using the rod antenna 38 and helical antenna 39 together for transmission and reception, for example, the helical antenna 39 is basically electrically connected to the transceiving circuit 41 through the hot side 44 of the unbalanced transmission line 42 and the rod antenna 38 is electrically connected to the transceiving circuit 41 through the ground side 45 of the unbalanced transmission line 42.

In case of the antenna device 40, however, the rod antenna 38 and helical antenna 39 respectively take an almost-balanced exciting attitude while the unbalanced transmission line 42 takes an unbalanced exciting attitude because of grounding the ground side 45, that is, the both antennas take exciting attitudes different from each other. Therefore, if the rod antenna 38 and helical antenna 39 are directly connected with the unbalanced transmission line 42, current unbalance occurs due to the difference between the exciting attitudes when the rod antenna 38 and helical antenna 39 operate as antennas.

As a result, in the cellular telephone 36, a leakage current i2 flows to a shielding case having a potential almost equal to that of the ground side 45 of the unbalanced transmission line 42 from the rod antenna 38 through the ground side 45 and thereby, the shielding case is operated as an antenna by the leakage current i2. Thus, when the housing 37 is approached to a hand or the head of a user, antenna characteristics of the cellular telephone 36 are deteriorated.

Figure 12:
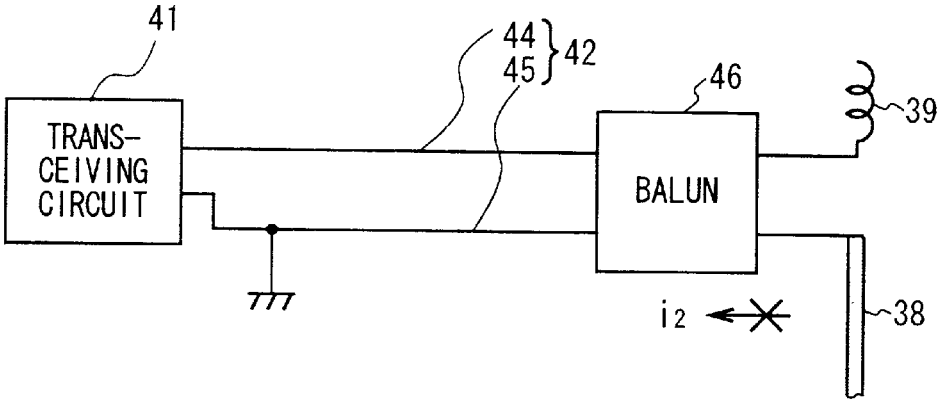
FIG. 12 is a schematic block diagram for explaining the connection between an unbalanced transmission line using a balun (Balanced-to-Unbalanced Transformer) on one hand and rod antenna and helical antenna on the other.

Therefore, as shown in FIG. 12, in the case of the antenna device 40 of the present invention, a balun (balanced-to-unbalanced transformer) 46 for performing balanced-to-unbalanced transform is set between the unbalanced transmission line 42 on one hand and the rod antenna 38 and helical antenna 39 on the other.

Figure 13:
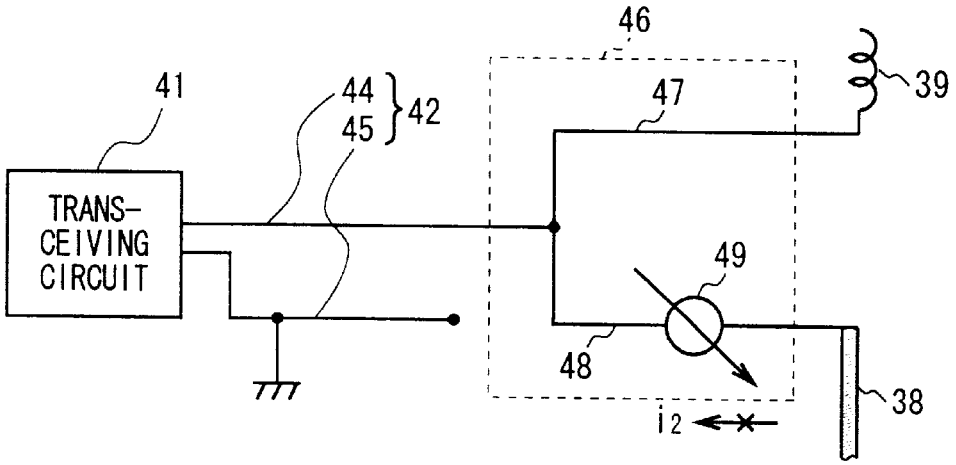
FIG. 13 is a block diagram showing the configuration of a balun.

As shown in FIG. 13, the balun 46 is configured by using two transmission lines such as first and second transmission lines 47 and 48 and setting a phase shifter 49 in the middle of the second transmission line 48.

Moreover, in case of the balun 46, one end of each of the first and second transmission lines 47 and 48 are electrically connected to the hot side 44 of the unbalanced transmission line 42 at the connection side (hereafter referred to as the unbalanced side) of the unbalanced transmission line 42 and the rod antenna 38 and helical antenna 39 are electrically connected to the other end of each of the first and second transmission lines 47 and 48 at the connection side (hereafter referred to as the balanced side) of an antenna element.

Figure 14:
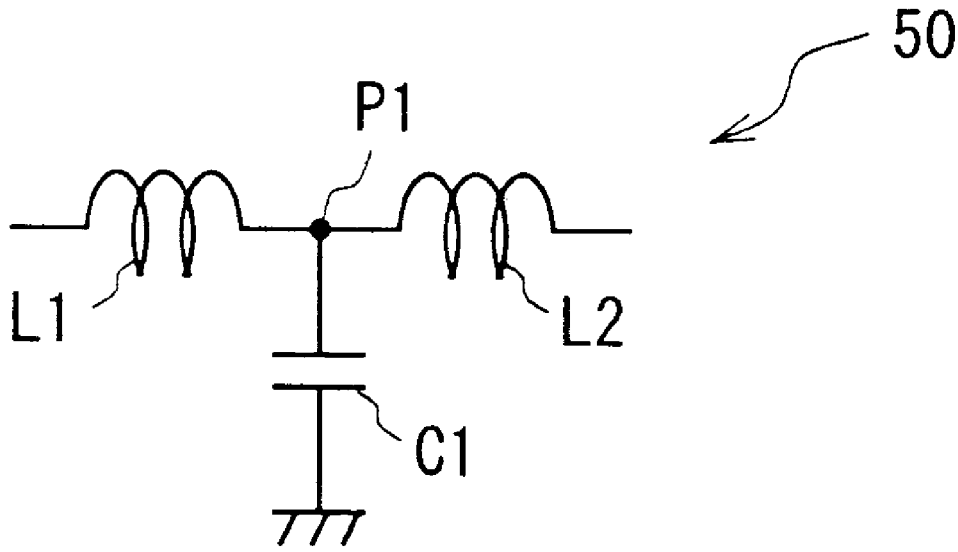
FIG. 14 is a block diagram showing the configuration of a phase circuit of a balun.

In this case, as shown in FIG. 14, the phase shifter 49 is configured by combining a plurality of symmetric-structure T-type phase circuits 50 obtained by connecting two inductive-reactance elements L1 and L2 in series, electrically connecting one end of a capacitive-reactance element C1 to the connective midpoint P1 between the elements L1 and L2 and grounding the other end of the capacitive-reactance element C1.

Furthermore, the balun 46 captures a high-frequency signal supplied from the transceiving circuit 41 through the hot side 44 of the unbalanced transmission line 42 from the unbalanced side, directly transmits the high-frequency signal to the balanced-side helical antenna 39 through the first transmission line 47, shifts the phase of the high-frequency signal by approximately 180° from the helical antenna 39 in a frequency band used in a phase shifter 49 of the second transmission line 48, and transmits the obtained phase-shifted high-frequency signal to the balanced-side rod antenna 38.

Thereby, the balun 46 allows the rod antenna 38 and helical antenna 39 to generate a voltage attitude same as that in FIGS. 4A and 4B described above through balanced-to-unbalanced transform and to operate as almost-electrically-symmetric balanced antennas.

Thus, the balun 46 can prevent a current unbalance from occurring in the rod antenna 38 and helical antenna 39 and prevent the leakage current i2 from flowing to the ground side 45 of the unbalanced transmission line 42 from the rod antenna 38 thereby preventing the shielding case from operating as an antenna.

In this connection, because the balun 46 can use a very-small chip of approximately 1 mm square for the phase shifter 49 as the inductive-reactance elements L1 and L2 and the capacitive-reactance element C of the phase circuit 50. Therefore, it is possible to greatly downsize the balun 46 as a whole and thus, easily provide the balun 46 for the cellular telephone 36 which tends to be decreased in size and weight.

Figure 9B:
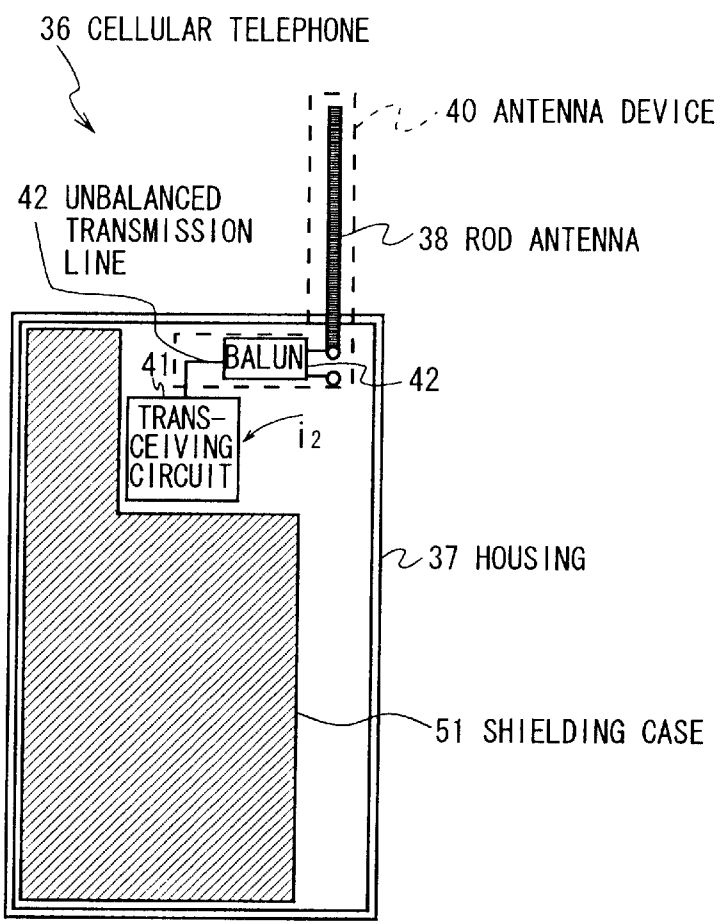
FIGS. 9A and 9B are schematic sectional views for explaining the theory of a cellular telephone of the present invention.
Figure 9A:
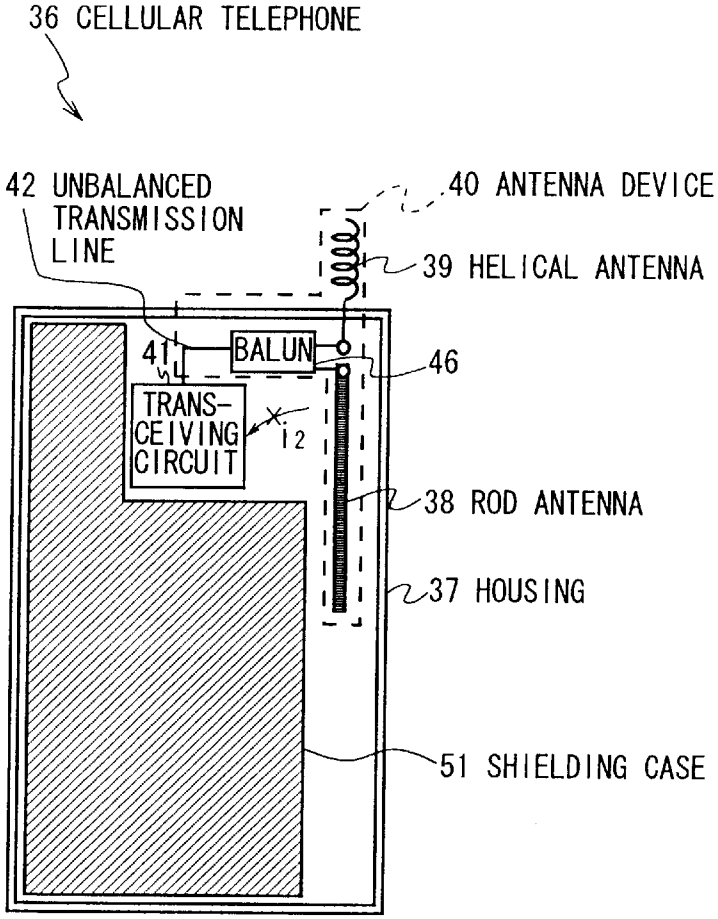

Moreover, in case of the antenna device 40 {FIGS. 9A and 9B}, when only the rod antenna 38 is used as a transceiving antenna element, only the rod antenna 38 is electrically connected to the balanced side of the balun 46. Under the above state, when power is supplied to the rod antenna 38 from the transceiving circuit 41 through the unbalanced transmission line 42 and the balun 46 in order, the rod antenna 38 is operated as an antenna.

In this case, in the antenna device 40, when only the rod antenna 38 is operated as an antenna as described above, balanced-to-unbalanced transform cannot be performed because there is not any antenna element to be electrically symmetric to the rod antenna 38 at the balanced side of the balun 46. Thereby, the leakage current i2 flows to the shielding case 51 from the ground side 45 of the unbalanced transmission line 42 similarly to the case of the conventional cellular telephone 1 {FIGS. 1A and 1B}.

Figure 15A:
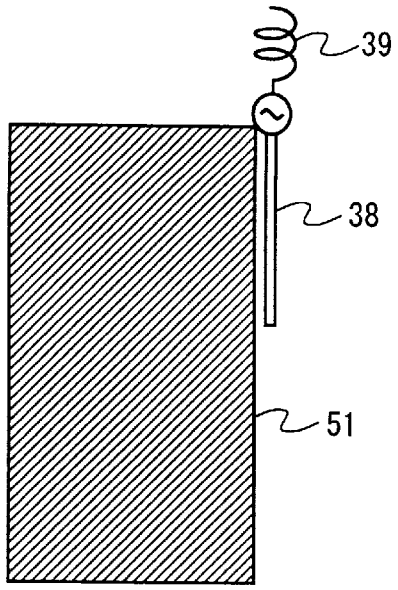
FIGS. 15A and 15B are schematic diagrams for explaining a shielding case when an antenna operates.
Figure 15B:
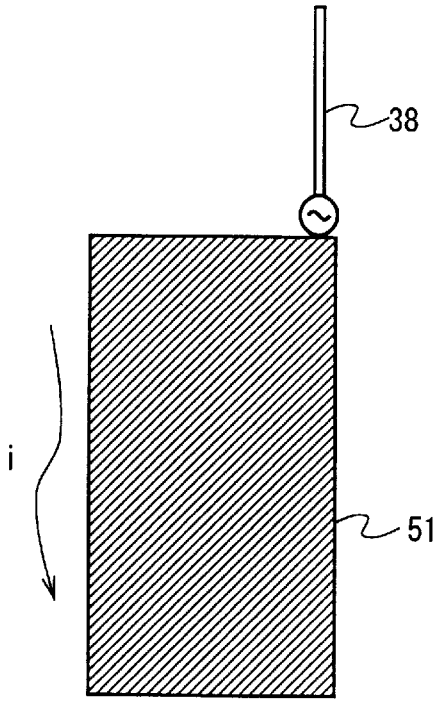

Therefore, in case of the cellular telephone 36 of the present invention, the shielding case 51 also operates as an antenna in accordance with the leakage current i2 at the time of making the rod antenna 38 protrude beyond the housing 37 and using only the rod antenna 38 as a transceiving antenna element as shown in FIGS. 15A and 15B.

In case of the rod antenna 38 of the cellular telephone 39 being retracted, however, at the time of making the helical antenna 39 protrude from the housing 37 and using the helical antenna 39 and the rod antenna 38 in the housing 37 as transceiving antenna elements, the helical antenna 39 and the rod antenna 38 are both operated as antennas but the shielding case 51 is prevented from operating as an antenna.

Thereby, the cellular telephone 39 makes it possible to greatly reduce the deterioration of antenna characteristics of the cellular telephone 36 nearby a human body and greatly reduce the deterioration of communication quality even if the housing 37 is held by a hand of a user or the housing 37 is approached to the head of the user because the shielding case 51 is not operated as an antenna.

Moreover, at the time of using the rod antenna 38 and helical antenna 39 as transceiving antenna elements, the cellular telephone 36 makes it possible to control power to be absorbed in a user and greatly lower the SAR by making the shielding case 51 function only as an original grounding and electrical shielding plate but not operate as an antenna.

In this connection, FIGS. 9A and 9B show the transceiving circuit 41 set outside of the shielding case 51 in the housing 37 in order to simplify the description. Actually, however, the transceiving circuit 41 is set inside of the shielding case 51. Moreover, though the balun 46 is set outside of the shielding case 51, it is also possible to set the balun 46 either inside or outside the shielding case 51.

Figure 16:
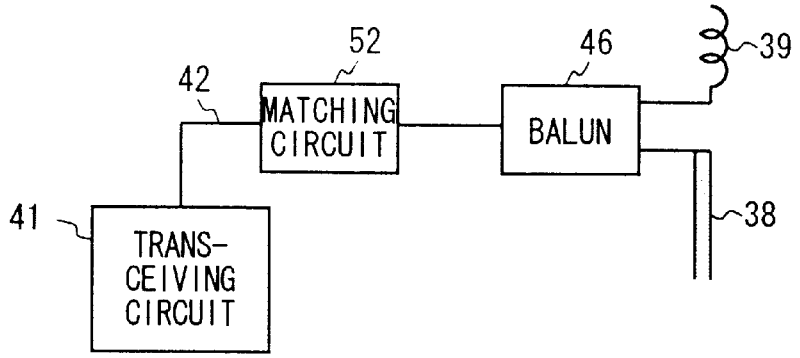
FIG. 16 is a block diagram for explaining the arrangement of a matching circuit at the unbalanced side of a balun.

Moreover, in FIGS. 9A and 9B and FIGS. 11 to 13, a matching circuit is omitted in order to simplify explanation. However, as shown in FIG. 16, a matching circuit 52 can be set for example, between the unbalanced transmission line 42 and the balun 46.

Figure 17:
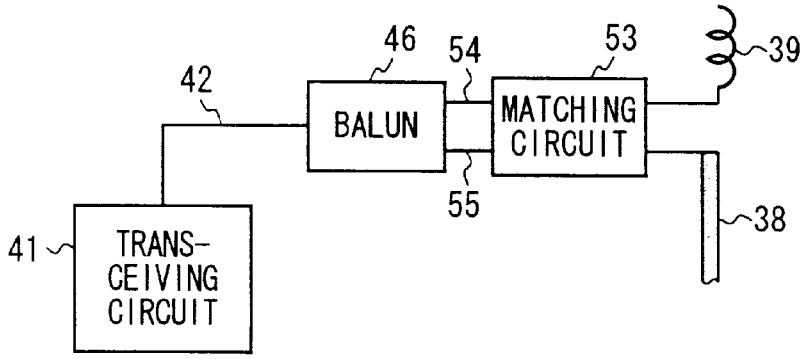
FIG. 17 is a block diagram for explaining the arrangement of a matching circuit at the balanced side of a balun.

Moreover, as shown in FIG. 17, a matching circuit 53 can be set between balun 46 on one hand and the rod antenna 38 and the helical antenna 39 on the other. In this case, however, if the matching circuit 53 is grounded, a leakage current generated in the helical antenna 39 flows to the shielding case 51 through the matching circuit 53 even if the balun 46 performs balanced-to-unbalanced transform and as a result, the shielding case 51 operates as an antenna.

Figure 18A:
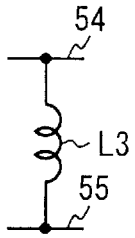
FIGS. 18A and 18B are block diagrams showing the configuration of a matching circuit set to the balanced side of a balun.
Figure 18B:
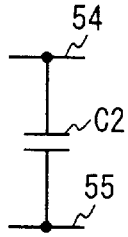

Therefore, as shown in FIGS. 18A and 18B by constituting the matching circuit 53 of a conductive-reactance element L3 or capacitive-reactance element C2 connected in parallel between the transmission lines 54 and 55 for electrically connecting the balanced side of the balun 46 with the rod antenna 38 and helical antenna 39 so as not to ground the matching circuit 53, it is possible to set the matching circuit 53 between the balun 46 on one hand and the rod antenna 38 and helical antenna 39 on the other with no problem.

(2) First Embodiment

Figure 19:
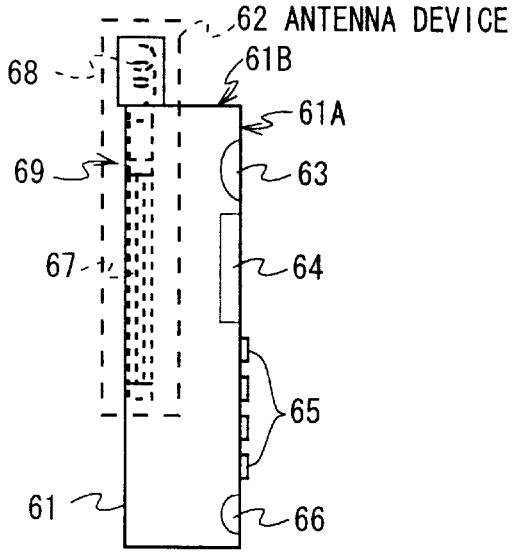
FIG. 19 is a schematic side view showing a first embodiment of the configuration of a cellular telephone of the present invention.

In FIG. 19, symbol 60 denotes a cellular telephone of first embodiment as a whole, which is configured by providing a whip antenna device 62 for a housing 61 made of a non-conductive material such as synthetic resin.

The housing 61 is formed like a box in which a loudspeaker 63, a liquid-crystal portion 64, various operation keys 65, and a microphone 66 are arranged on the front 61A.

In case of the antenna device 62, an antenna section 69 having a rod antenna 67 and a helical antenna 68 serving as first and second antenna elements is set to the back 61C of the upper face 61B of the housing 61 in almost parallel with the longitudinal direction of the housing 61 (hereafter referred to as housing longitudinal direction) so as to be freely retracted and pulled out.

Moreover, the cellular telephone 60 is arranged so as to reduce the deterioration of antenna characteristics of the cellular telephone 60 nearby a human body because the rod antenna 67 and helical antenna 68 of an antenna section 69 can be separate from the head of a user even if the front 61A of the housing 61 is approached to the head of the user because of setting the antenna section 69 to the back 61C of the housing 61.

Figure 20:
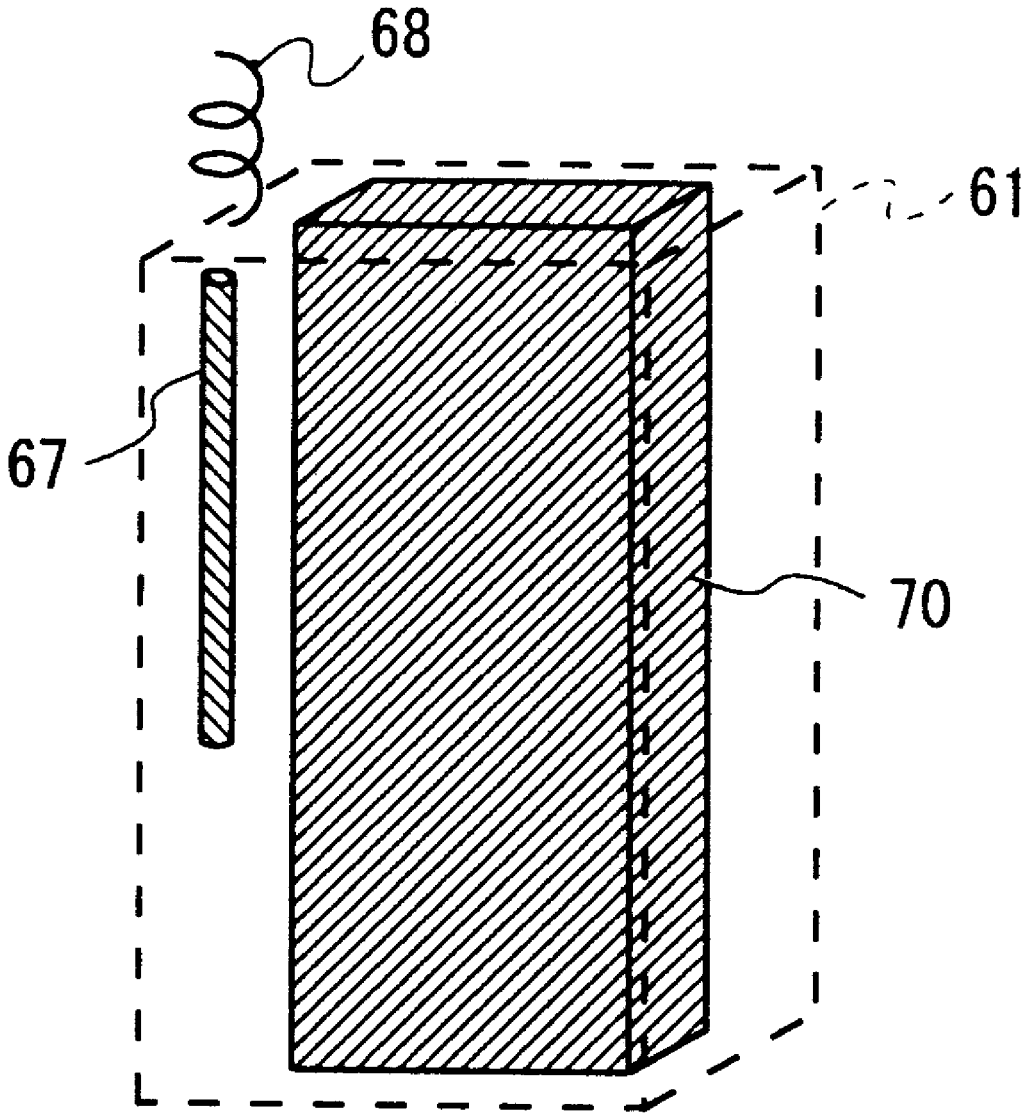
FIG. 20 is a schematic diagram for explaining the arrangement of a rod antenna, a helical antenna, and a shielding case.

Furthermore, as shown in FIG. 20 the cellular telephone 60 is arranged so as to prevent a shielding case 70 from being capacity-coupled with the shielding case 70 and operating as an antenna at the time of operating the rod antenna 67 and helical antenna 68 as antennas by electrically separating the rod antenna 67 and helical antenna 68 of the antenna section 69 from the shielding case 70 stored in the housing 61.

Figure 21A:
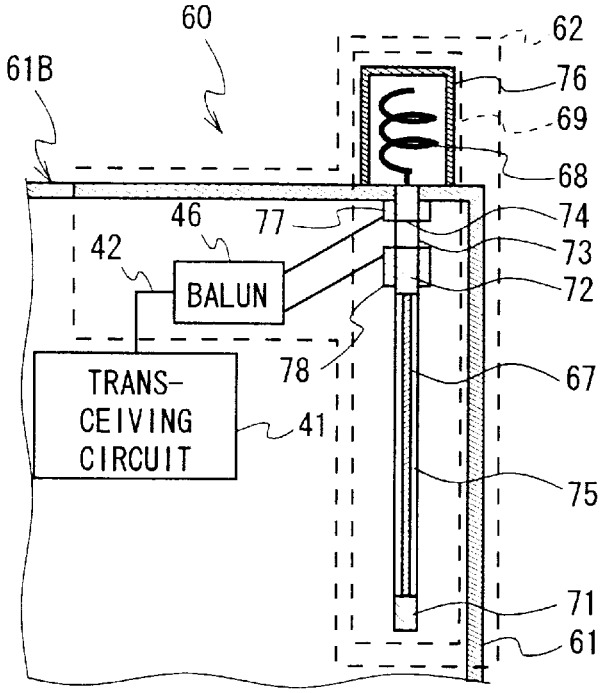
FIGS. 21A and 21B are block diagrams showing the internal configuration of a cellular telephone of the first embodiment.
Figure 21B:
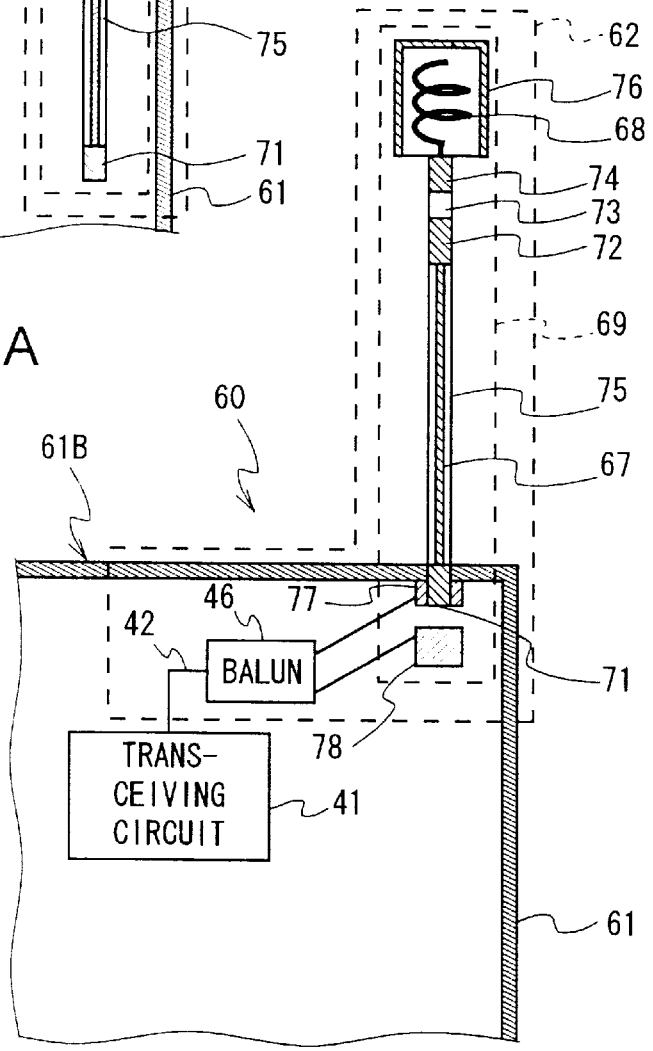

Actually, FIGS. 21A and 21B show an internal configuration of the cellular telephone 60 excluding a matching circuit and a shielding case, in which a circuit board (not illustrated) on which various circuit devices such as the transceiving circuit 41 and balun 46 are mounted is stored in the housing 61 and moreover, a shielding case made of a conductive material to cover the circuit board is stored in the housing 61.

Moreover, the transceiving circuit 41 is electrically connected to the unbalanced side of the balun 46 through the unbalanced transmission line 42 configured of a microstrip line formed on the circuit board.

Furthermore, in the antenna device 62, a rod-antenna bottom power-supply member 71 made of a conductive material is electrically and mechanically connected to the lower end of the rod antenna 67, a rod-antenna top-power-supply member 72 made of a conductive material is electrically and mechanically connected to the upper end of the rod antenna 67, and a joint 73 made of a nonconductive material is mechanically connected to the rod-antenna top-power-supply member 72.

Furthermore, a helical-antenna power-supply member 74 made of a conductive material is electrically and mechanically connected to the lower end of the helical antenna 68 and the helical-antenna power-supply member 74 is mechanically connected to the joint 73. Thereby, the helical antenna 68 and rod antenna 67 are mechanically connected to each other by the joint 73 but they are electrically separated from each other.

Furthermore, the rod antenna 67 is covered with a rod-antenna cover 75 made of a nonconductive material and the helical antenna 68 is stored in a helical-antenna cover 76 made of a nonconductive material and formed like a cap so as not to directly contact a user.

Moreover, in the antenna section 69, top- and bottom-antenna power-supply terminals 77 and 78 respectively made of a conductive material and formed like a ring are electrically separately arranged inside of the upper face 61B of the housing 61 and the rod antenna 67 is inserted into the top- and bottom-antenna power-supply terminals 77 and 78 respectively.

Furthermore, the top- and bottom-antenna power-supply terminals 77 and 78 are electrically connected to the balanced side of the balun 46.

Thereby, in the antenna device 62, when the antenna section 69 is retracted, the helical-antenna cover 76 is pushed in the retracting direction and made to contact with the upper face 61B of the housing 61 to electrically connect the helical-antenna power-supply member 74 to the top-antenna power-supply terminal 77 and electrically connect the rod-antenna top-power-supply member 72 to the bottom-antenna power-supply terminal 78.

Thus, in the antenna device 62, the rod antenna 67 is stored in the housing 61 and the helical antenna 68 is protruded from the upper face 61B of the housing 61 while the rod antenna 67 and helical antenna 68 are electrically connected to the balanced side of the balun 46.

Moreover, in the antenna device 62, when power is supplied to the rod antenna 67 and helical antenna 68 from the transceiving circuit 41 through the unbalanced transmission line 42 and balun 46 in order under the above state, the rod antenna 67 and helical antenna 67 are brought into the same voltage attitude as that described above for FIGS. 4A and 4B and operated as almost-balanced antennas.

Furthermore, in the antenna device 62, a leakage current is prevented from flowing to the ground side of the unbalanced transmission line 42 from the rod antenna 67 in accordance with the balanced-to-unbalanced transform by the balun 46, a shielding case is prevented from operating as an antenna because a leakage current resultantly flows to the shielding case from the ground side of the unbalanced transmission line 42, and the shielding case is made to function only as original electrical shielding plate and ground.

Furthermore, in the antenna device 62, when the antenna section 69 is pulled out, the helical-antenna cover 76 is pulled in the pull-out direction, thereby the rod-antenna bottom power-supply member 71 is electrically connected to the top-antenna power-supply terminal 77 and only the rod antenna 67 is electrically connected to the balanced side of the balun 46 to electrically separate the helical antenna 68.

Thereby, in the antenna device 62, when power is supplied to the rod antenna 67 from the transceiving circuit 41 through the unbalanced transmission line 42 and balun 46 in order under the above state, the rod antenna 67 is operated as an antenna.

Moreover, in the antenna device 62, a leakage current flows to the shielding case from the ground side of the unbalanced transmission line 42 in the above case and thereby, the shielding case also operates as an antenna.

Thus, in the cellular telephone 60, the portability is improved by pushing the rod antenna 67 into the housing 61 when actually retracting the antenna section 62, a transmission signal is supplied to the rod antenna 67 and helical antenna 68 from the transceiving circuit 41 through the unbalanced transmission line 42 and balun 46 in order under the above state, the signal is transmitted to a base station through the rod antenna 67 and helical antenna 68, and a reception signal transmitted from the base station and received by the rod antenna 67 and helical antenna 68 is supplied to the transceiving circuit 41 through the balun 46 and unbalanced transmission line 42 in order.

Moreover, in the cellular telephone 60, when the antenna section 62 is pulled out, the antenna section 62 is easily pulled out by holding the helical-antenna cover 76, a high-frequency transmission signal is supplied to the rod antenna 67 through the unbalanced transmission line 42 and balun 46 in order and transmitted to a base station (not illustrated) through the rod antenna 67, and a high-frequency reception signal transmitted from the base station and received by the rod antenna 67 is supplied to the transceiving circuit 41 through the balun 46 and unbalanced transmission line 42 in order.

Then, in the cellular telephone 60, when the antenna section 69 is pulled out, antenna characteristics near a human body deteriorate because the shielding case operates as an antenna. When the antenna section 69 is retracted, however, it is possible to greatly reduce the deterioration of antenna characteristics of the cellular telephone 60 near a human body even if the housing 61 is held by a hand of the user or brought near the head of the user by preventing the shielding case from operating as an antenna.

Moreover, in the cellular telephone 60, it is possible to greatly reduce the power to be absorbed in a user, that is, the SAR by preventing the shielding case from operating as an antenna in the above case.

Furthermore, in the cellular telephone 60, it is possible to secure a frequency band comparatively wider than that of the helical antenna 68 because the physical length of the helical antenna 68 is larger than that of the rod antenna 67.

Furthermore, in the cellular telephone 60, it is possible to always secure a comparatively-low frequency band by operating the rod antenna 67 as an antenna when the antenna section 69 is retracted and pulled out.

(3) Second Embodiment

Figure 22A:
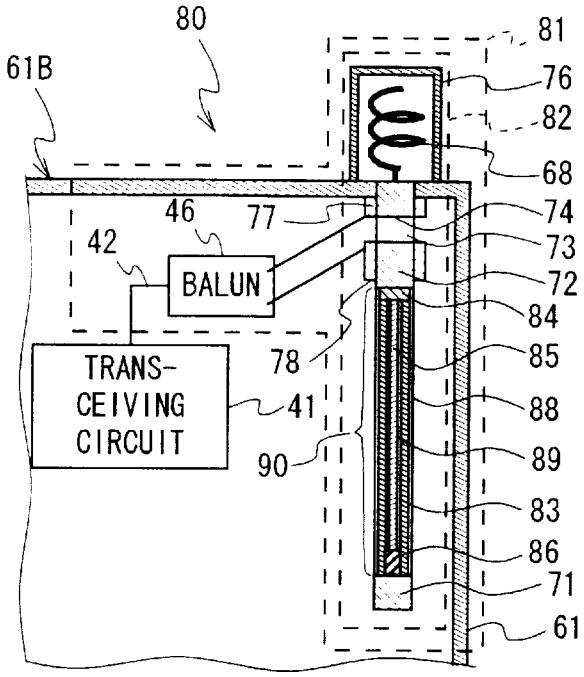
FIGS. 22A and 22B are block diagrams showing the internal configuration of a second embodiment.
Figure 22B:
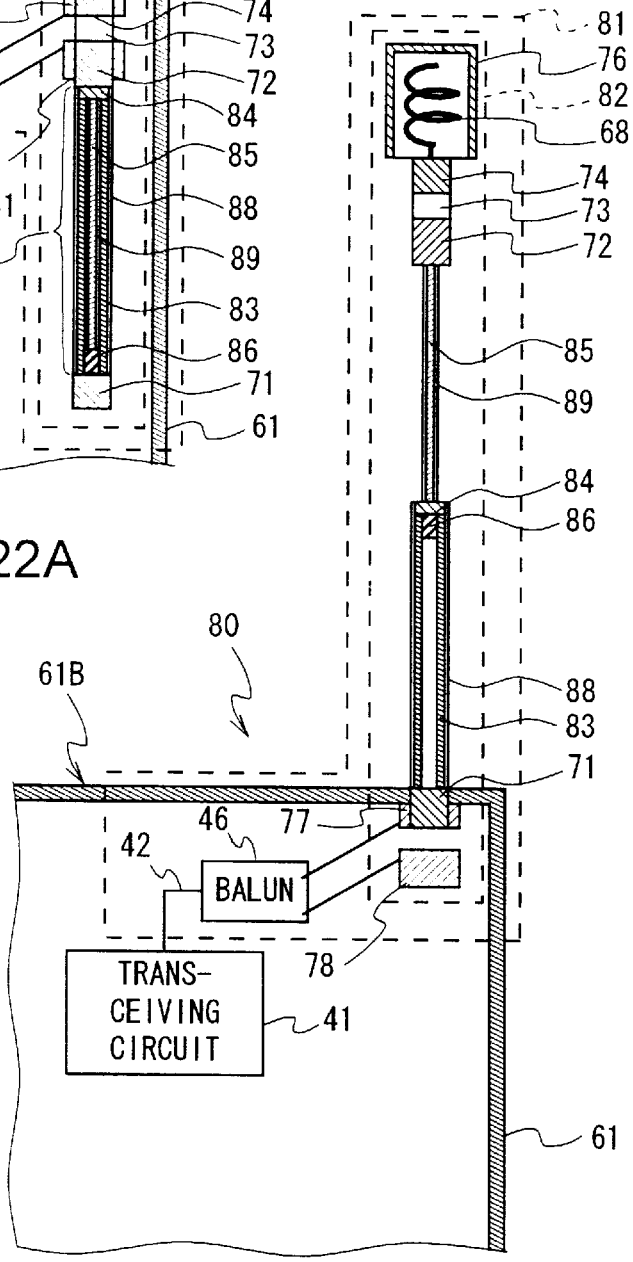

FIGS. 22A and 22B shown by providing the same symbols for portions corresponding to those in FIGS. 21A and 21B show a cellular telephone 80 of the second embodiment, which is similarly configured by the cellular telephone 60 {FIGS. 21A and 21B} of the above first embodiment except the configuration of an antenna section 82 of an antenna device 81.

Figure 23A:
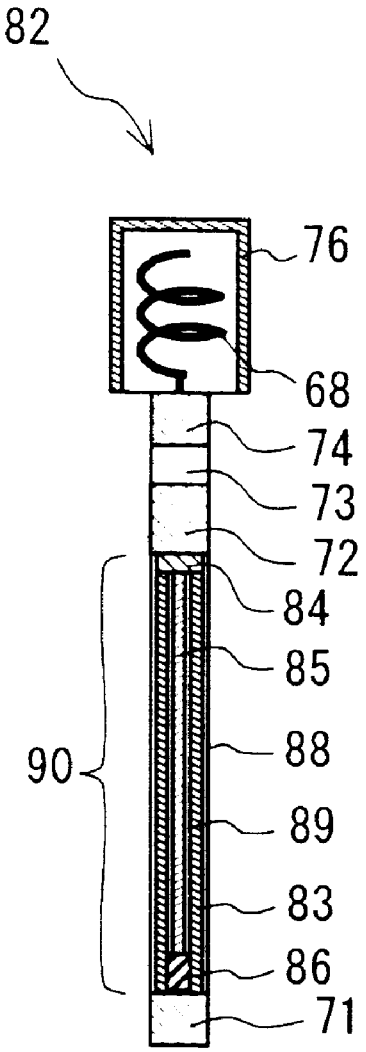
FIGS. 23A and 23B are schematic sectional views showing the configuration of an antenna section of the second embodiment.
Figure 23B:
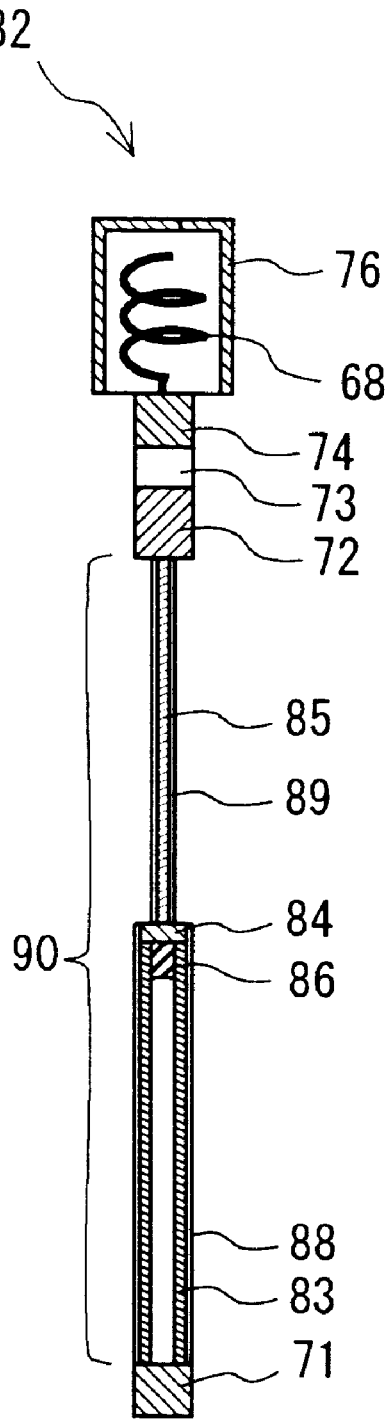

In FIGS. 23A and 23B shown by proving same symbols for portions corresponding to those in FIGS. 21A and 21B, the antenna section 82 is configured so that a rod-antenna bottom power-supply member 68 is electrically and mechanically connected to the lower end of a first antenna half-body 83 configured by a conductive cylindrical member, a pull-out stop section 84 is provided for the upper end of the first antenna half-body 83, and a second antenna half-body 85 configured by a conductive rod member is inserted into a hole of the first antenna half-body 83 so as to be freely retracted and pulled out.

Moreover, a sliding spring 86 made of a conductive material is electrically and mechanically connected to the lower end of the second antenna half-body 85 located in the hole of the first antenna half-body 83 and a rod-antenna top power-supply member 72 is electrically and mechanically connected to the upper end of the second antenna half-body 85.

Moreover, a helical-antenna power-supply member 74 is mechanically connected to the rod-antenna top power-supply member 72 through a joint 73 and thereby, the second antenna half-body 85 and the helical antenna 68 are mechanically connected by a joint 87 but they are electrically separated from each other.

Furthermore, the first and second antenna half-bodies 83 and 85 are covered with antenna covers 88 and 89.

Thereby, in the antenna section 82, when the second antenna half-body 85 is pushed into or pull out of the first antenna half-body 83, the sliding spring 86 slides in the hole of the first antenna half-body 83 and a rod antenna 90 which can be extended and contracted by the first and second antenna half-bodies 83 and 85 is formed by electrically connecting the first antenna half-body 83 with the second antenna half-body 85 through the sliding spring 86.

Actually in the antenna device 81 {FIGS. 22A and 22B}, when the antenna section 82 is retracted and the helical antenna cover 76 is pushed in the retracting direction, the antenna section 82 is pushed into the housing 61 while pushing the second antenna half-body 85 into the first antenna half-body 83.

Then, in the antenna device 81, when the helical antenna cover 76 is made to contact with the upper face 61B of the housing 61, the rod antenna 90 contracted by the first and second antenna half-bodies 83 and 85 is formed by pushing the second antenna half-body 85 into the first antenna half-body 83 and stored in the housing 61.

Moreover, in this case, the antenna device 81 electrically connects the helical-antenna power-supply member 74 to the top-antenna power-supply terminal 77 and the rod-antenna top power-supply member 72 to the bottom-antenna power-supply terminal 78 and thus, electrically connects the helical antenna 68 and the contracted rod antenna 90 to the balanced of the balun 46.

In this connection, in the antenna device 81, when power is supplied to the helical antenna 68 and the contracted rod antenna 90 from the transceiving circuit 41 through the unbalanced transmission line 42 and balun. 46 in order under the above state, the helical antenna 68 and contracted rod antenna 90 are made to operate as almost-balanced antennas and in this case, a leakage current is prevented from flowing from the contracted rod antenna 90 to the ground side of the unbalanced transmission line 42 in accordance with the balanced-to-unbalanced transform by the balun 46.

Moreover, in the antenna device 81, when the antenna section 82 is pulled out and the helical-antenna cover 76 is pulled in the pull-out direction, the antenna section 82 is pulled to the outside from the upper face 61B of the housing 61 while the second antenna half-body 85 is pulled out of the first antenna half-body 83.

Furthermore, in the antenna device 81, when the second antenna half-body 85 is fully pulled out of the first antenna half-body 83 and the rod antenna 90 extended by the first and second antenna half-bodies 83 and 85 is formed, the rod-antenna bottom power-supply member 71 is electrically connected to the top antenna power-supply terminal 77. Thus, the extended rod antenna 90 is electrically connected to the balanced of the balun 46 and the helical antenna 68 is electrically separated from the balanced of the balun 46.

Therefore, in the cellular telephone 80, when the antenna section 82 is pushed in, the rod antenna 90 contracted by the first and second antenna half-bodies 83 and 85 is formed and pushed into the housing 61. Thereby, a portion of the antenna section 82 to be pushed into the housing 61 can be greatly shortened compared to the case of the cellular telephone of the first embodiment {FIGS. 21A and 21B}.

Therefore, in the cellular telephone 80, even when the antenna section 82 is not easily pushed into the housing 61 due to a space occupied by a battery or the like, it is possible to set the antenna section 82 to the upper face 61B of the housing 61 so as to be freely retracted and pulled out.

Moreover, the cellular telephone 80 makes it possible to secure a comparatively-wide frequency band by operating the rod antenna 90 as an antenna at the time of retracting and pulling out the antenna section 82.

(4) Third Embodiment

Figure 24:
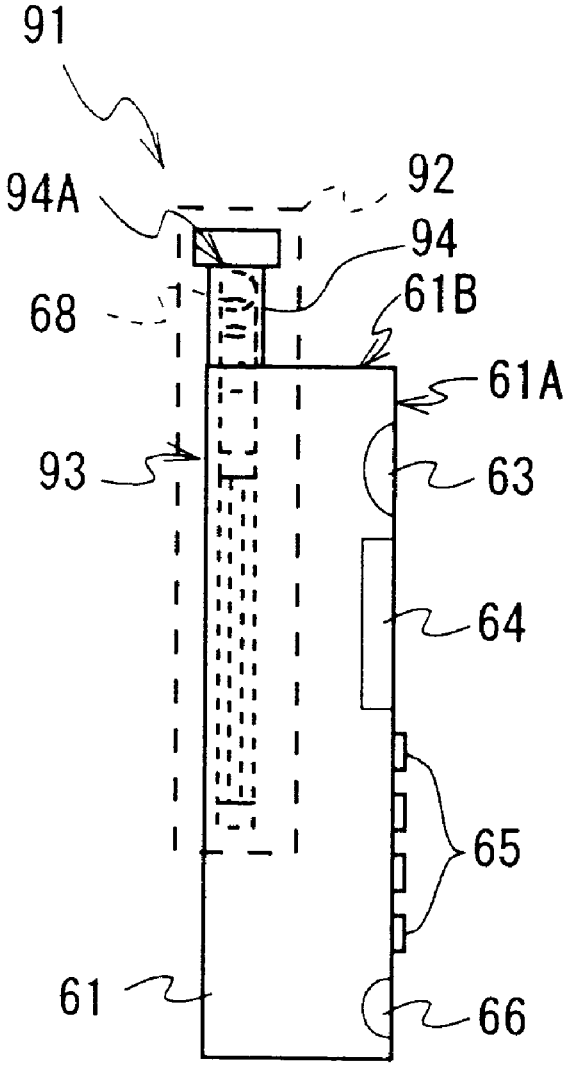
FIG. 24 is a schematic side view showing the configuration of a cellular telephone of a third embodiment.

FIG. 24 shown by providing the same symbol for a portion corresponding to that of FIG. 19 shows a cellular telephone 91 of the third embodiment which is configured similarly to the cellular telephone 60 (FIG. 19) of the above-described first embodiment except the configuration of an antenna section 93 of an antenna device 92.

In this antenna section 93, a helical antenna 68 is set in a helical antenna cover 94 set to the back-61C side of the upper face 61B of a housing 61 and at rod antenna 67 is set to the upper face 94A of the helical antenna cover 94 so as to be freely retracted and pulled out along the longitudinal direction of the housing.

Figure 25A:
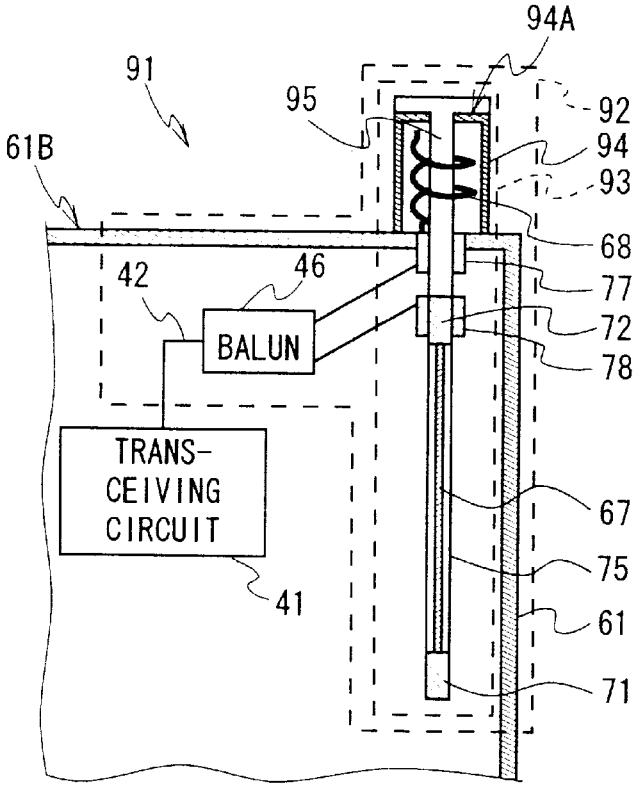
FIGS. 25A and 25B are block diagrams showing the internal configuration of a cellular telephone of the third embodiment.
Figure 25B:
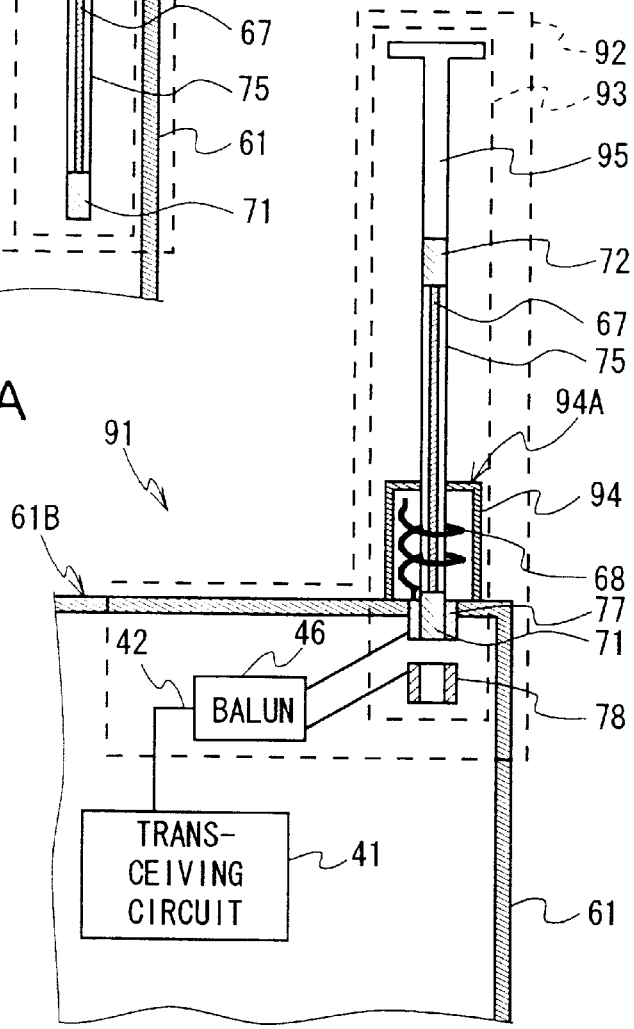

Actually, in FIGS. 25A and 25B shown by providing the same symbol for a portion corresponding to that in FIGS. 21A and 21B, the lower end of the helical antenna 68 of the antenna section 93 is directly electrically connected to a top antenna power-supply terminal 77.

Moreover, an antenna knob 95 made of a nonconductive material and having a T-shaped cross section is set to the upper end of the rod antenna 67 through a rod-antenna top power-supply member 72.

Moreover, in the antenna device 92, the rod antenna 67 is pushed in and pulled out along the axis of the helix of the helical antenna 68.

Actually in the antenna device 92, when the rod antenna 67 is retracted and the antenna knob 95 is pushed in the retracting direction and made to contact with the upper face 94A of the helical antenna cover 94, the antenna knob 95 is inserted into the helical antenna 68 and top antenna power-supply terminal 77, and the rod-antenna top power-supply member 72 is electrically connected to the bottom antenna power-supply terminal 78.

Thereby, in the antenna device 92, the rod antenna 67 as well as the helical antenna 68 positioned at the side of the upper face 91B of the housing 61 are electrically connected to the balanced of the balun 46.

Moreover, in the antenna device 92, when power is supplied to the helical antenna 68 and rod antenna 67 from a transceiving circuit 41 through an unbalanced transmission line 42 and the balun 46 in order under the above state, the helical antenna 68 and rod antenna 67 are operated as almost-unbalanced antennas and in this case, a leakage current is prevented from flowing from the rod antenna 67 to the ground side of the unbalanced transmission line 42 in accordance with the balanced-to-unbalanced transform by the balun 46.

In this connection, in the antenna device 92, when the rod antenna 67 is pulled out and the antenna knob 95 is pulled in the pull-out direction, a rod-antenna bottom power-supply member 71 is electrically connected to the top antenna power-supply terminal 77, and a composite antenna is formed by the rod antenna 67 and helical antenna 68 and electrically connected to the balanced of the balun 46.

Then, in the antenna device 92, when power is supplied to the composite antenna from the transceiving circuit 41 through the unbalanced transmission line 412 and the balun 46 in order under the above state, the composite antenna is operated as an antenna.

Therefore, the cellular telephone 91 makes it possible to greatly reduce the deterioration of antenna characteristics of the cellular telephone 91 near a human body even if the housing 61 is held by a hand of a user or brought close to the head of the user and a shielding case is located near a human body by preventing the shielding case from operating as an antenna when the rod antenna 67 is retracted similarly to the case of the first embodiment described above. Moreover, it is possible to greatly reduce the power absorbed by a human body, that is, the SAR.

Moreover, the cellular telephone 91 makes it possible to always secure a comparatively-wide frequency band by operating the rod antenna 67 as an antenna when the rod antenna 67 is retracted and pulled out.

(5) Fourth Embodiment

Figure 26A:
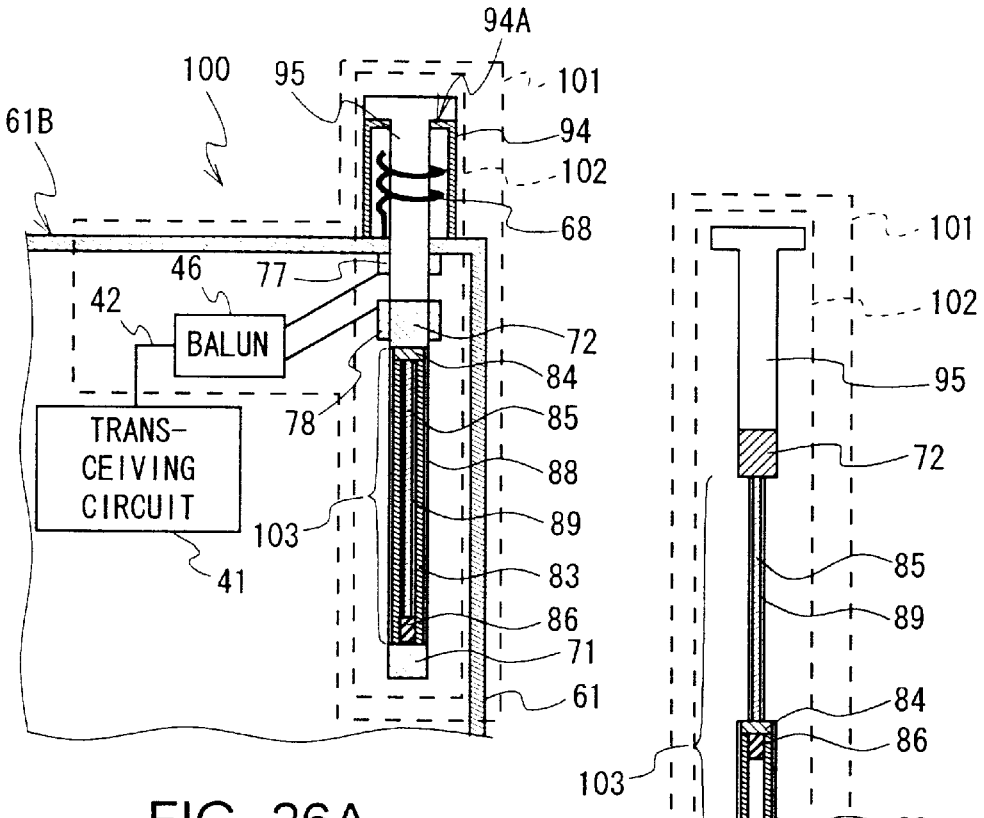
FIGS. 26A and 26B are block diagrams showing the internal configuration of a cellular telephone of a fourth embodiment.
Figure 26B:
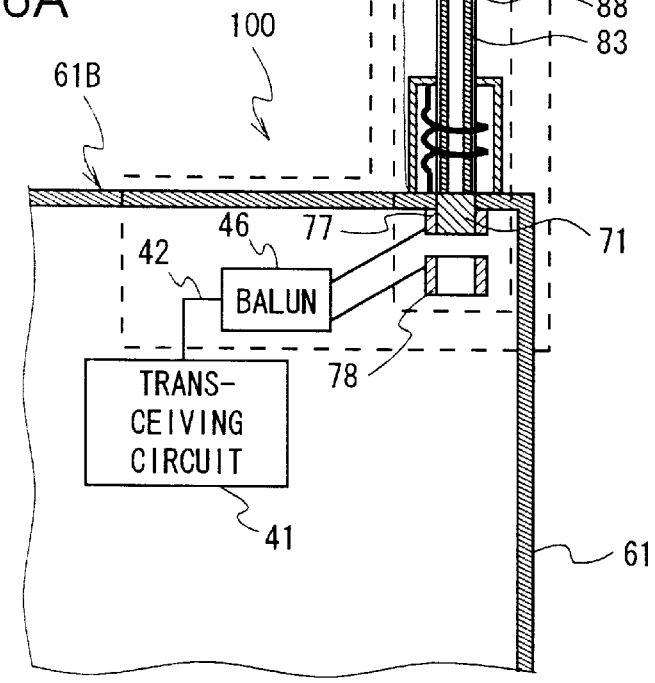

FIGS. 26A and 26B shown by providing the same symbol for a portion corresponding to that in FIGS. 25A and 25B show a cellular telephone 100 of the fourth embodiment, which is configured similarly to the cellular telephone 91 {FIGS. 25A and 25B} of the above-described third embodiment except the configuration of an antenna section 102 of an antenna device 101.

Figure 27:
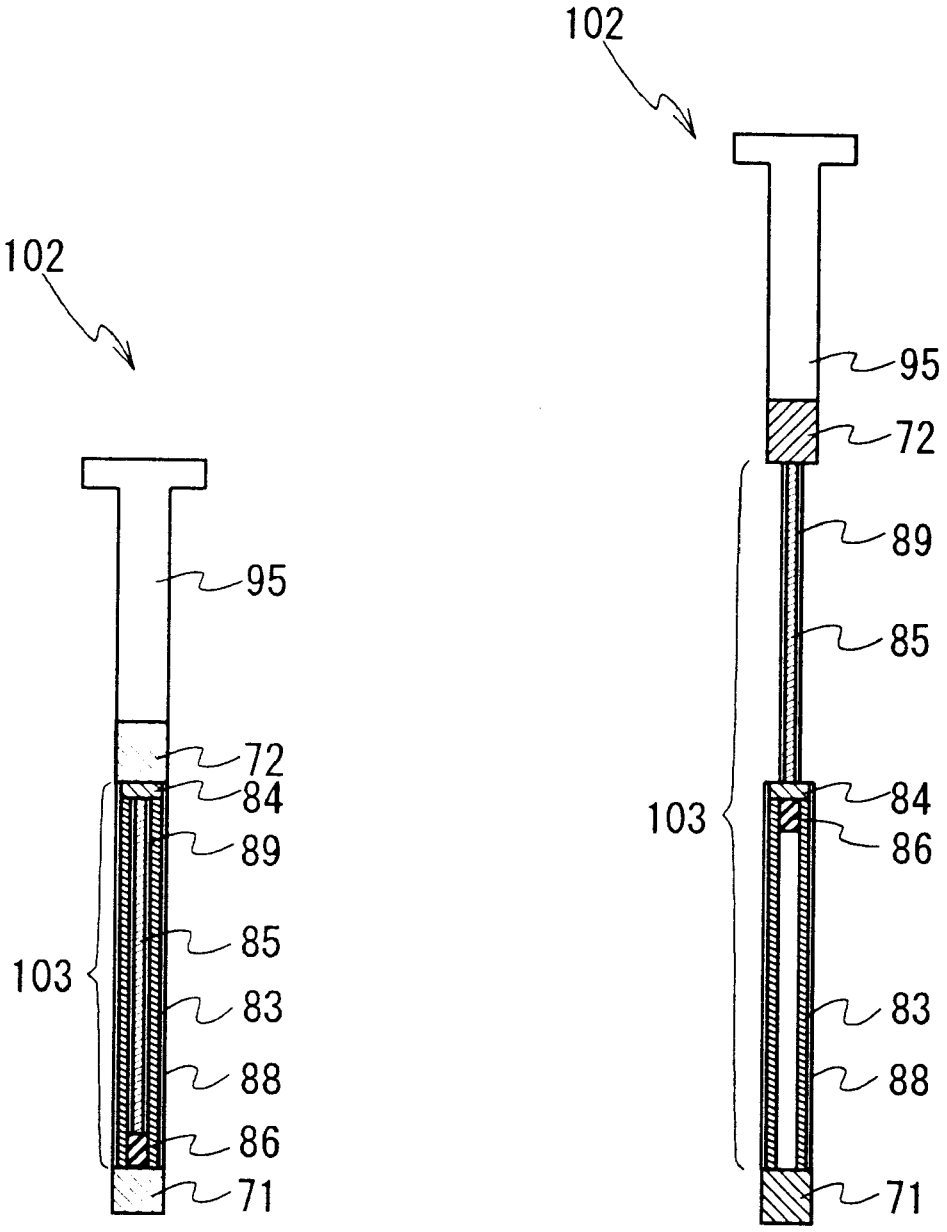
FIG. 27 is a schematic sectional view showing the configuration of an antenna section of the fourth embodiment.

In FIGS. 27A and 27B shown by providing the same symbol for a portion corresponding to that in FIGS. 25A and 25B and FIGS. 23A and 23B, the antenna section 102 has a retractable rod antenna 103 in which a second antenna half-body 85 is inserted into a first antenna half-body 83 so as to be freely retracted and pulled out and a rod-antenna top power-supply member 72 is electrically and mechanically connected to the upper end of the second antenna half-body 85.

Moreover, in the antenna device 101, when the rod antenna 103 is pulled out and the antenna knob 95 is pulled in the pull-out direction, the rod antenna 103 is extended by pulling out the second antenna half-body 85 from the first antenna half-body 83. When the second antenna half-body 85 is fully pulled out from the first antenna half-body 83, a rod-antenna bottom power-supply member 71 is electrically connected to a top antenna power-supply terminal 77 to form a composite antenna by the helical antenna 68 and the extended rod antenna 103.

Moreover, in the antenna device 101, when the rod antenna 103 is pulled out and the antenna knob 95 is pulled in the pull-out direction, the rod antenna 103 is extended by pulling out the second antenna half-body 85 from the first antenna half-body 83. When the second antenna half-body 85 is fully pulled out from the first antenna half-body 83, a rod-antenna bottom power-supply member 71 is electrically connected to a top antenna power-supply terminal 77 to form a composite antenna by the helical antenna 68 and the extended rod an n103.

Thereby, in the cellular telephone 100, when the rod antenna 103 is pushed in, it is possible to greatly shorten a portion of the rod antenna 103 to be pushed into the housing 61 by contracting the rod antenna 103 when the rod antenna 103 is pushed in compared to the case of the cellular telephone 91 of the above third embodiment.

Therefore, the cellular telephone 100 makes it possible to easily set the rod antenna 103 in the housing 61 even when it is not easy to push in the rod antenna 103 due to a space occupied by a battery or the like.

Moreover, the cellular telephone 91 makes it possible to always secure a comparatively-wide frequency band by operating the rod antenna 103 as an antenna when the rod antenna 103 is both retracted and pulled out.

(6) Fifth Embodiment

Figure 28A:
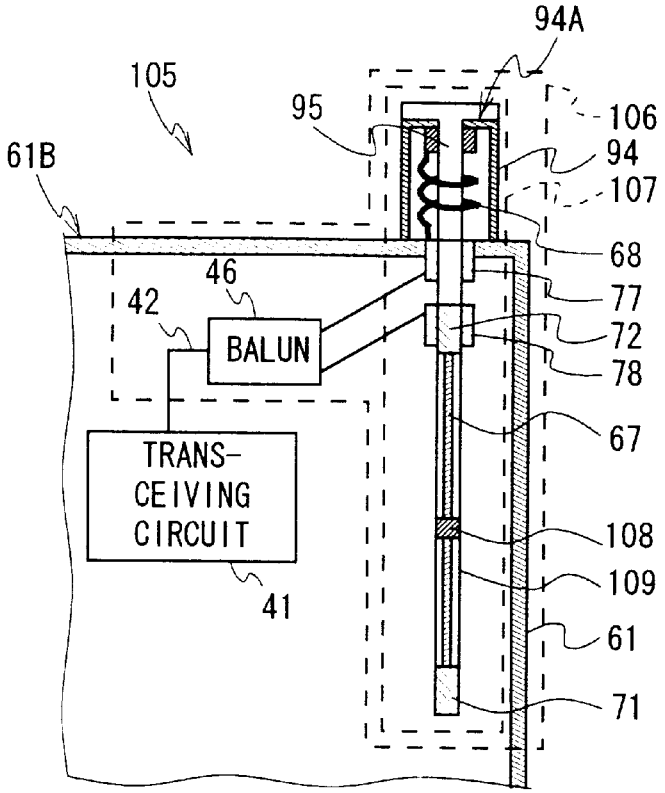
FIGS. 28A and 28B are block diagrams showing the internal configuration of a cellular telephone of a fifth embodiment.
Figure 28B:
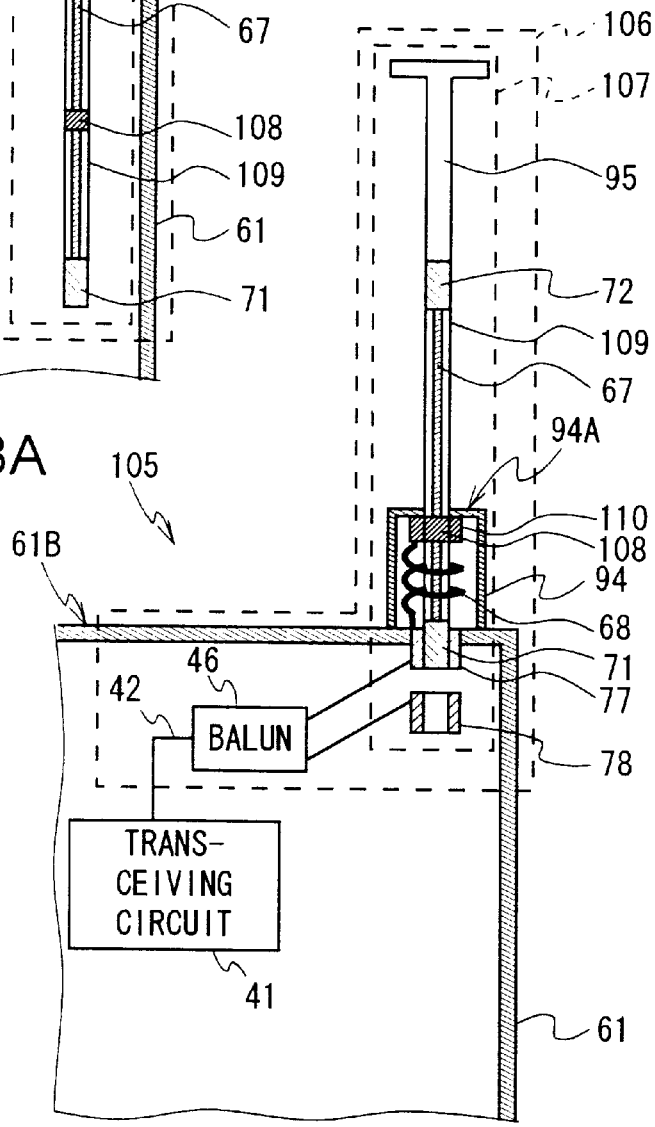

FIGS. 28A and 28B shown by providing the same symbol for a portion corresponding to FIGS. 25A and 25B show a cellular telephone 105 of the fifth embodiment which is configured similarly to the cellular telephone 91 {FIGS. 25A and 25B} of the above-described third embodiment except the configuration of an antenna section 107 of an antenna device 106.

In the antenna section 107, a short-circuit member 108 made of a conductive material is electrically and mechanically connected to a predetermined portion along the longitudinal direction of a rod antenna 67 and the rod antenna 67 is covered with a rod antenna cover 109 made of a nonconductive material so as to expose the periphery of the short-circuit member 108.

Moreover, an annular helical antenna short-circuit terminal 110 made of a conductive material is set inside of the upper face 94A of a helical antenna cover 94. Furthermore, the helical short-circuit terminal 110 is electrically and mechanically connected to the upper end of a helical antenna 68.

In this case, in the antenna device 106, when the rod antenna 67 is retracted and an antenna knob 95 is pushed in the retracting direction and made to contact with the upper face 94A of the helical antenna cover 94, the antenna knob 95 is inserted into the helical short-circuit terminal 110, helical antenna 68, and top antenna power-supply terminal 77 in order, to electrically connect a rod-antenna top power-supply member 72 to a bottom antenna power-supply terminal 78.

Thereby, in the antenna device 106, the rod antenna 67 is electrically connected to the balanced side of a balun 46 together with the helical antenna 68 set to the upper face 91B of a housing 61.

Then, in the antenna device 106, when power is supplied to the helical antenna 68 and rod antenna 67 from a transceiving circuit 41 through an unbalanced transmission line 42 and the balun 46 in order under the above state, the helical antenna 68 and rod antenna 67 are operated as almost-balanced antennas and in this case, a leakage current is prevented from flowing from the rod antenna 67 to the ground side of the unbalanced transmission line 42 in accordance with the balanced-to-unbalanced transform by the balun 46.

In this connection, in the antenna device 106, when the rod antenna 67 is pulled out and the antenna knob 95 is pulled in the pull-out direction, a rod-antenna bottom power-supply member 71 is electrically connected to the bottom antenna power-supply terminal 78 and the short-circuit member 108 is electrically connected to the helical short-circuit terminal 110. Thus, the upper and lower ends of the helical antenna 68 are short-circuited with the rod antenna 67 to from a composite antenna.

In this case, in the antenna device 106, when power is supplied to the composite antenna from the transceiving circuit 41 through the unbalanced transmission line 42 and balun 46 in order, the helical antenna 68 of the composite antenna does not operate as an antenna because of the short circuit with the rod antenna 67 so that only the rod antenna 67 is operated as an antenna.

Therefore, the cellular telephone 106 makes it possible to greatly reduce the deterioration of antenna characteristics of the cellular telephone 91 near a human body even if the housing 61 is held by a hand of a user or the housing 61 is brought close to the head of the user and a shielding case is located near a human body because the shielding case is not operated as an antenna when the rod antenna 67 is retracted, similarly to the case of the above-described third embodiment. Moreover, it is possible to greatly reduce the SAR by controlling the power to be absorbed by a human body from the shielding case.

Moreover, the cellular telephone 91 makes it possible to always secure a comparatively-wide frequency band by operating the rod antenna 68 as an antenna when the rod antenna 67 is retracted and pulled out.

(7) Sixth Embodiment

Figure 29A:
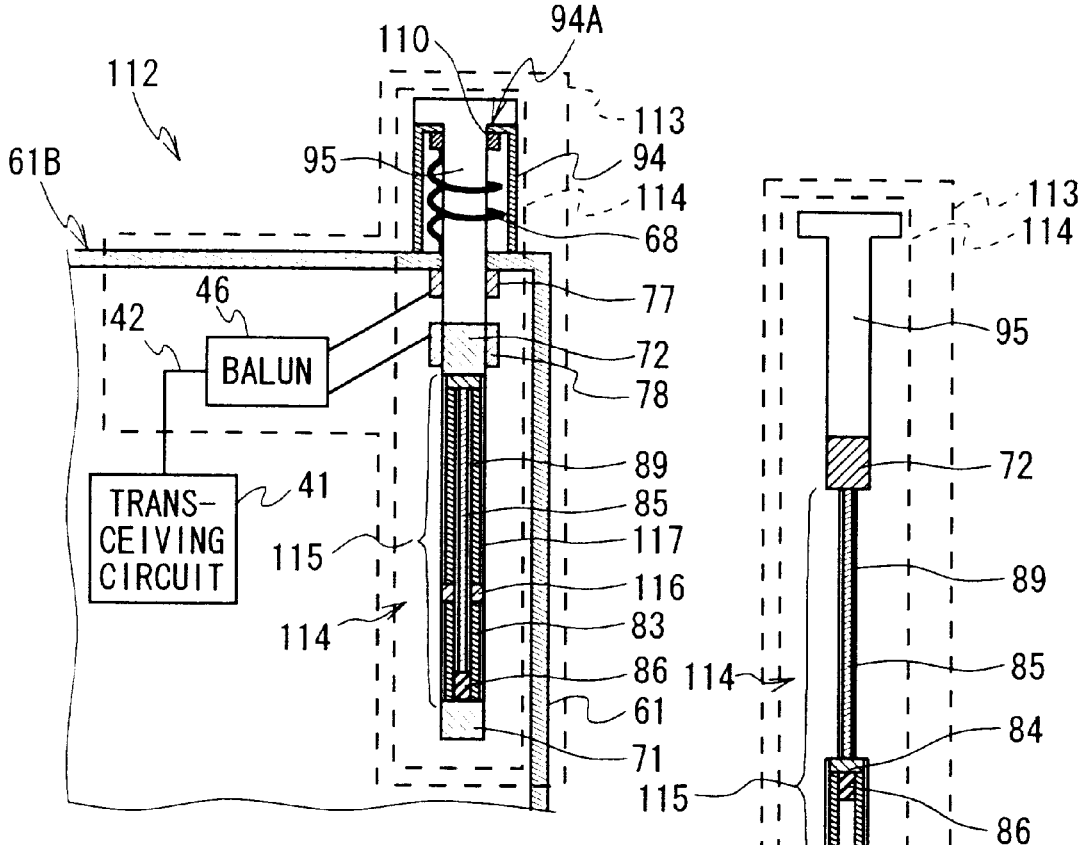
FIGS. 29A and 29B are block diagrams showing the internal configuration of a cellular telephone of a sixth embodiment.
Figure 29B:
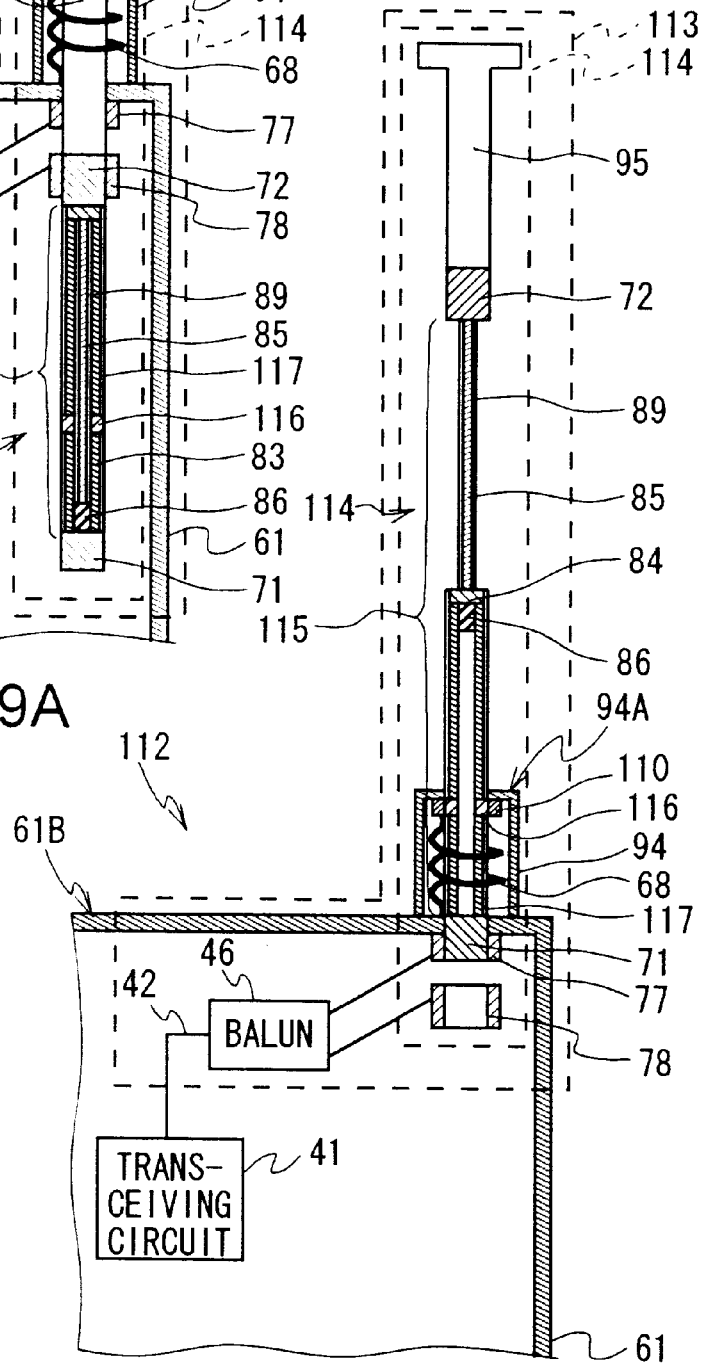

FIGS. 29A and 29B shown by providing the same symbol for a portion corresponding to that in FIGS. 28A and 28B show a cellular telephone 112 of the sixth embodiment, which is configured similarly to the cellular telephone 105 {FIGS. 28A and 28B} of the fifth embodiment except the configuration of an antenna section 114 of an antenna device 113.

Figure 30A:
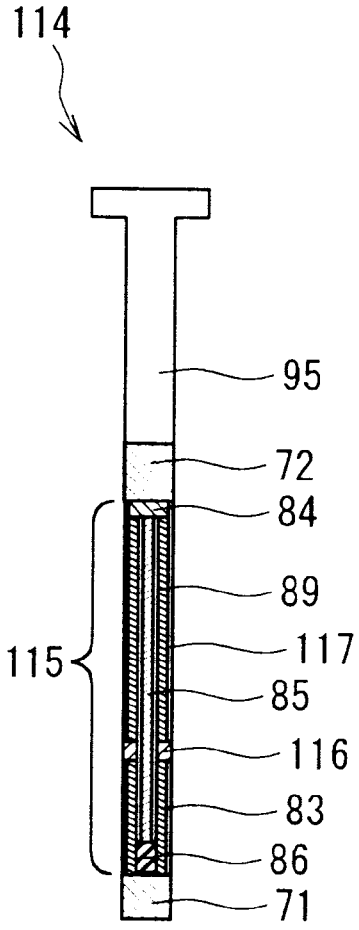
FIGS. 30A and 30B are schematic sectional views showing the configuration of an antenna section of the sixth embodiment.
Figure 30B:
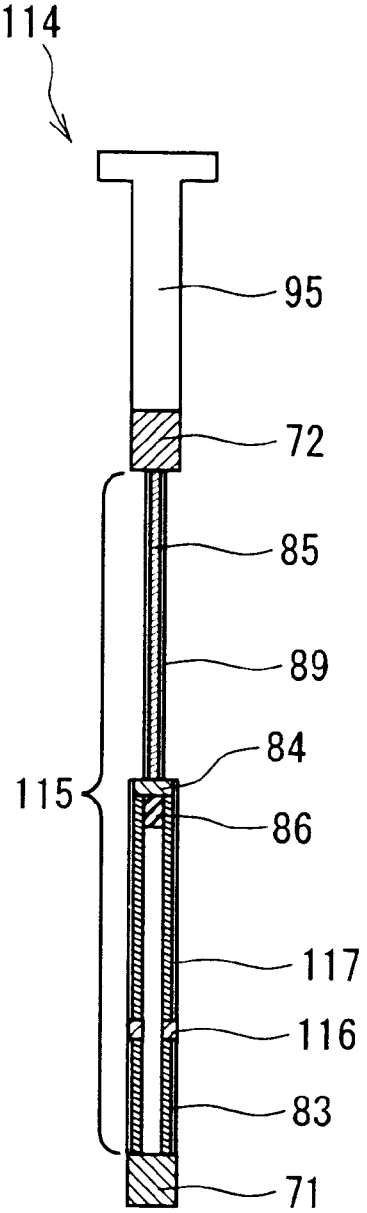

In this case, in FIGS. 30A and 30B shown by providing the same symbol for a portion corresponding to that in FIGS. 28A and 28B and FIGS. 27A and 27B, the antenna section 114 has a retractable rod antenna 115 in which a second antenna half-body 85 is inserted into a first antenna half-body 83 so as to be freely retracted and pulled out, a short-circuit member 116 is electrically and mechanically connected to a predetermined portion of the first antenna half-body 83, and the first antenna half-body 83 is covered with a rod antenna cover 117 made of a nonconductive material so as to expose the periphery of the short-circuit member 116.

Then, in the antenna device 113 {FIGS. 29A and 29B}, when the rod antenna 115 is retracted and an antenna knob 95 is pushed in the retracting direction and made to contact with the upper face 94A of a helical antenna cover 94, the rod antenna 115 is contracted by pushing the second antenna half-body 85 into the first antenna half-body 83, the contracted rod antenna 115 is stored in the housing 61, and a rod-antenna top power-supply member 72 is electrically connected to a bottom antenna power-supply terminal 78.

Moreover, in the antenna device 113, when the rod antenna 115 is pulled out and the antenna knob 95 is pulled in the pull-out direction, the second antenna half-body 85 is pulled out of the first antenna half-body 83 to extend the rod antenna 115. In this case, the rod-antenna bottom power-supply member 71 is electrically connected to the top antenna power-supply terminal 77 and the short-circuit member 116 is electrically connected to the helical short-circuit terminal 116. Thus, upper and lower ends of the helical antenna 68 are short-circuited with the extended rod antenna 115 to form a composite antenna.

Thus, the cellular telephone 112 makes it possible to greatly shorten a portion of the rod antenna 115 to be pushed into the housing 61 compared to the case of the cellular telephone of the fifth embodiment by contracting the rod antenna 115 and pushing the antenna 115 into the housing 61 when the rod antenna 115 is pushed in.

Therefore, the cellular telephone 112 makes it possible to easily set the rod antenna 115 in the housing 61 so as to be freely retracted and pulled out even when it is difficult to easily push in the rod antenna 115 due to a space occupied by a battery or the like.

Moreover, the cellular telephone 112 makes it possible to always secure a comparatively-wide frequency band by operating the rod antenna 115 as an antenna at the time of both pushing in and pulling out the rod antenna 115.

(8) Seventh Embodiment

Figure 31A:
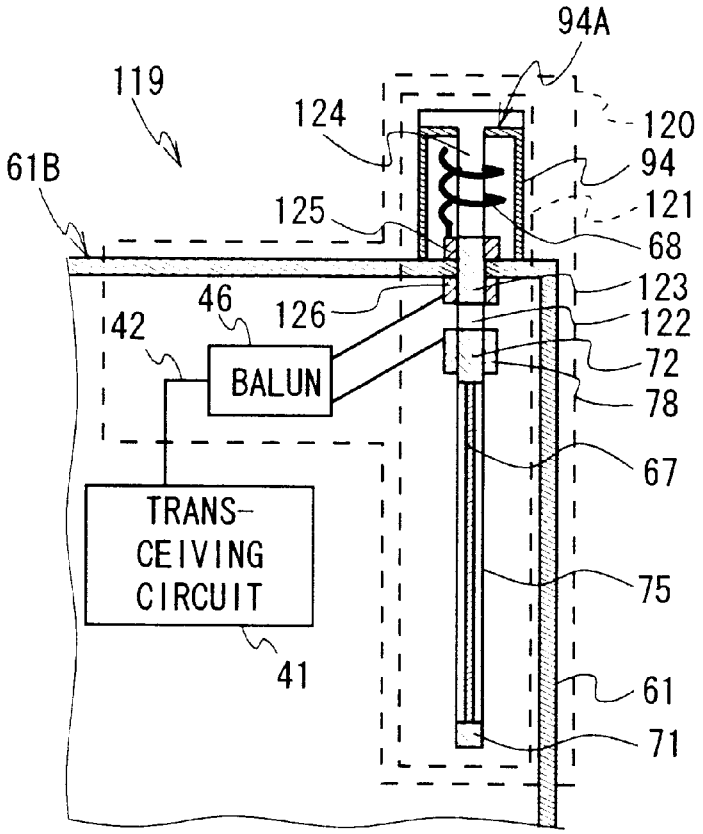
FIGS. 31A and 31B are block diagrams showing the internal configuration of a cellular telephone of a seventh embodiment.
Figure 31B:
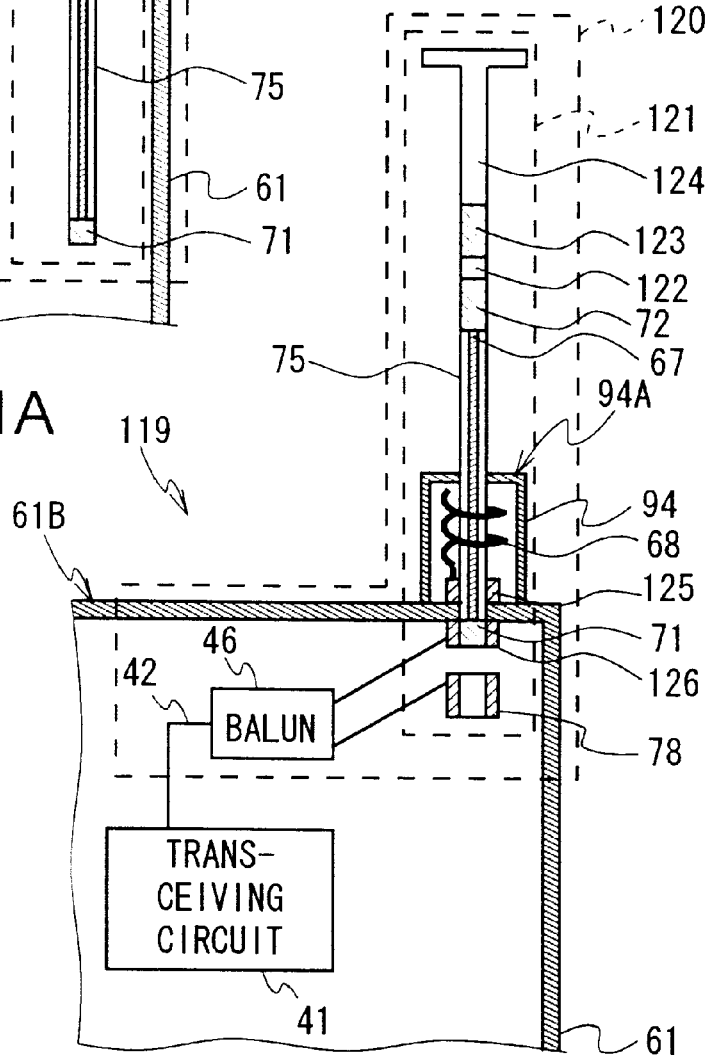

FIGS. 31A and 31B shown by providing the same symbol for a portion corresponding to FIGS. 25A and 25B show a cellular telephone 119 of the seventh embodiment, which is configured similarly to the cellular telephone 91 {FIGS. 25A and 25B} except the configuration of an antenna section 121 of an antenna device 120.

In the antenna section 121, a joint 122 made of a non-conductive material is mechanically connected to a rod-antenna top power-supply member 72 of at rod antenna 67, an antenna member 123 made of a conductive material is mechanically connected to the joint 122, and moreover an antenna knob 124 made of a nonconductive material is mechanically connected to the antenna member 123. Thereby, the rod antenna 67 and antenna member 123 are mechanically connected each other by the joint 122 but they are electrically separated from each other.

Moreover, an annular helical-antenna power-supply member 125 made of a conductive material is electrically and mechanically connected to the lower end of the helical antenna 68.

Moreover, in the antenna device 120, an annular top-antenna power-supply terminal 126 made of a conductive material is set inside of the upper face 61B of the housing 61 and electrically connected to the balanced of a balun 26.

Furthermore, in the antenna device 120, the rod antenna 67 is inserted into the helical antenna 68, helical-antenna power-supply member 125, and top antenna power-supply terminal 126 so as to be pushed in and pulled out.

Actually in the antenna device 120, when the rod antenna 67 is retracted and the antenna knob 124 is pushed in the retracting direction and made to contact with the upper face 94A of the helical antenna cover 94, the antenna member 123 is electrically connected to the helical-antenna power-supply member 125 and top antenna power-supply terminal 126 and the rod-antenna top power-supply member 72 is electrically connected to the bottom antenna power-supply terminal 78.

Thereby, in the antenna device 120, the antenna member 123 is electrically connected to the helical antenna 68 to form a composite antenna and the rod antenna 67 is electrically connected to the balanced of the balun 46 together with the composite antenna.

Moreover, in the antenna device 120, when power is supplied to the composite antenna and the rod antenna 67 from a transceiving circuit 41 through an unbalanced transmission line 42 and the balun 46 in order under the above state, the composite antenna and the rod antenna 67 are operated as almost-balanced antennas and in this case, a leakage current is prevented from flowing to the ground side of the unbalanced transmission line 42 from the rod antenna 67 in accordance with the balanced-to-unbalanced transform by the balun 46, and thus a shielding case is prevented from operating as an antenna.

Moreover, in the antenna device 120, when the rod antenna 67 is pulled out and the antenna knob 124 is pulled in the pull-out direction, the rod-antenna bottom power-supply member 71 is electrically connected to the top antenna power-supply terminal 126 and thus, only the rod antenna 67 is electrically connected to the balanced of the balun 46.

Thereby, in the antenna device 120, when power is supplied to the helical antenna 68 from the transceiving circuit 41 through the unbalanced transmission line 42 and balun 46 in order, the helical antenna 68 is operated as an antenna.

Thus, the cellular telephone 119 makes a shielding case function as only an original electrical shielding plate and ground without operating as an antenna when the rod antenna 67 is retracted and thereby, makes it possible to greatly reduce the deterioration of antenna characteristics of the cellular telephone 119 nearby a human body and moreover, greatly decrease the SAR by controlling the power to be absorbed in a human body from the shielding case.

Moreover, the cellular telephone 119 makes it possible to secure a comparatively-wide frequency band by operating the rod antenna 67 as an antenna when the rod antenna 67 is both retracted and pulled out.

(9) Eighth Embodiment

Figure 32A:
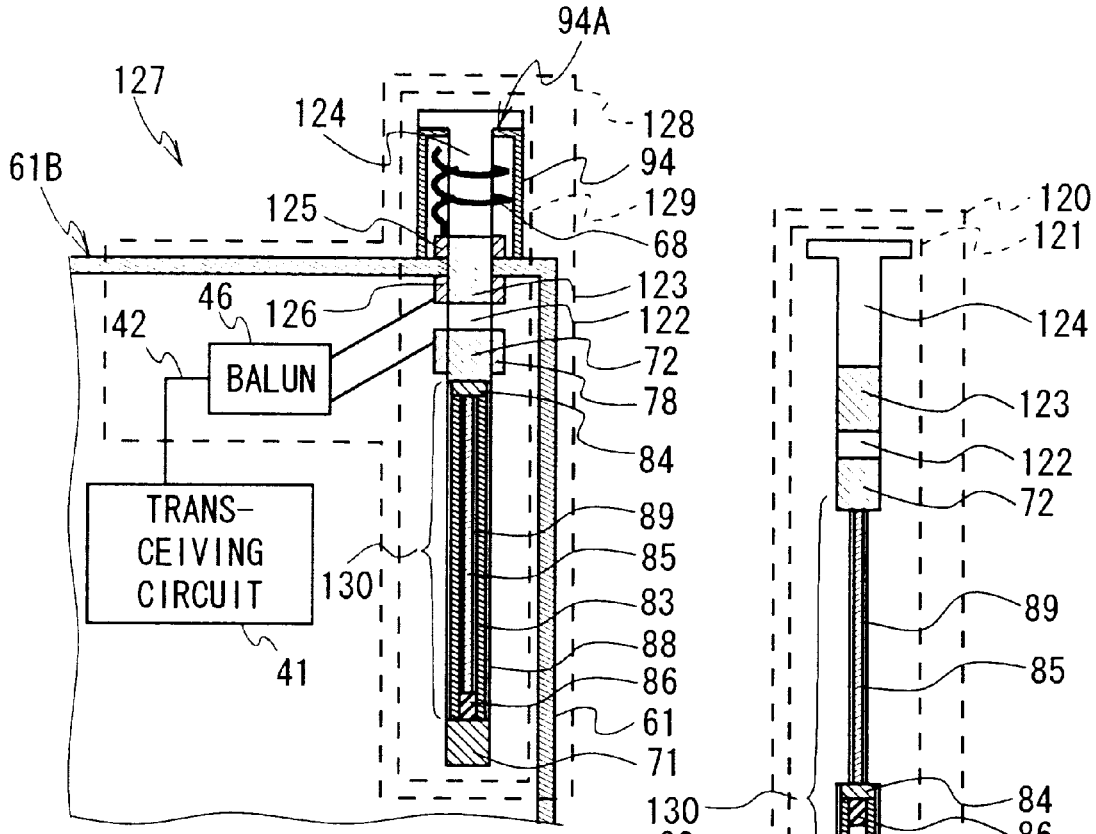
FIGS. 32A and 32B are block diagrams showing the internal configuration of a cellular telephone of an eighth embodiment.
Figure 32B:
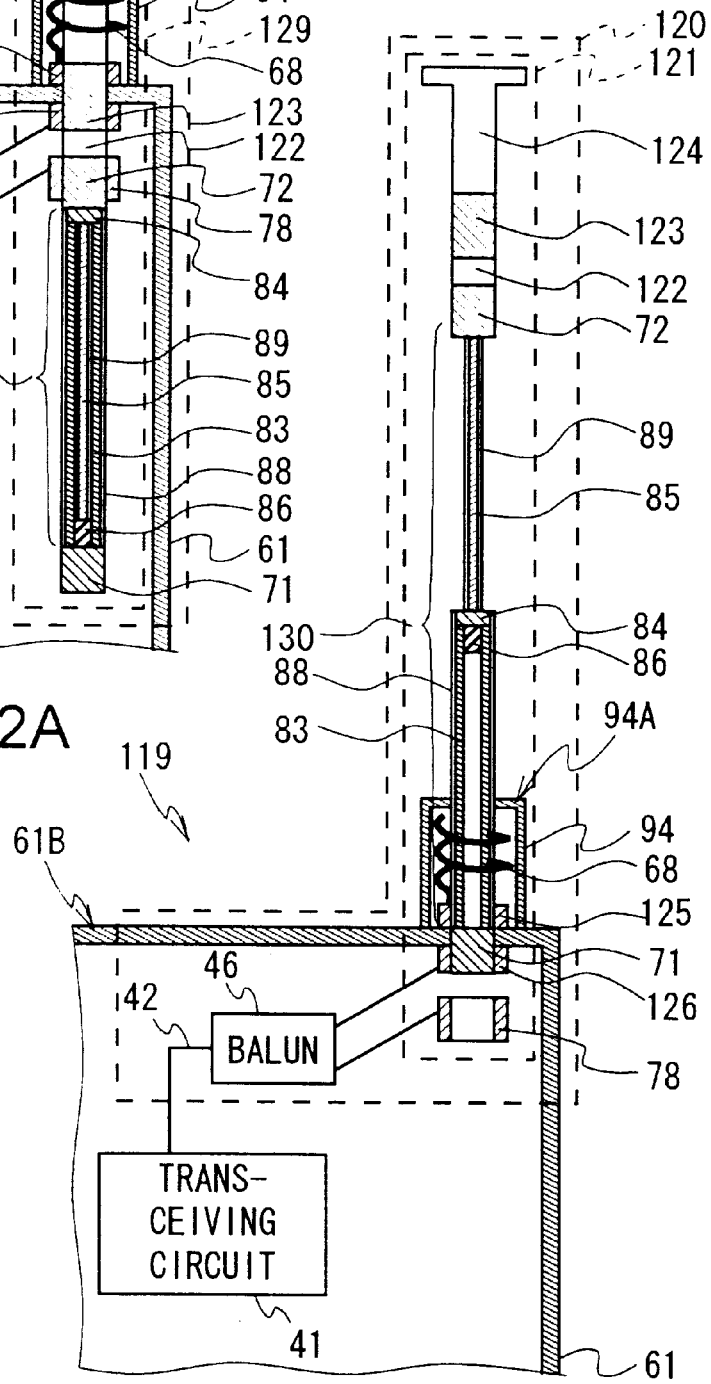

FIGS. 32A and 32B shown by providing the same symbol for a portion corresponding to that in FIGS. 31A and 31B show a cellular telephone 127 of the eighth embodiment, which is configured similarly to the cellular telephone 119 {FIGS. 31A and 31B} of the seventh embodiment except the configuration of an antenna section 129 of an antenna device 128.

Figure 33A:
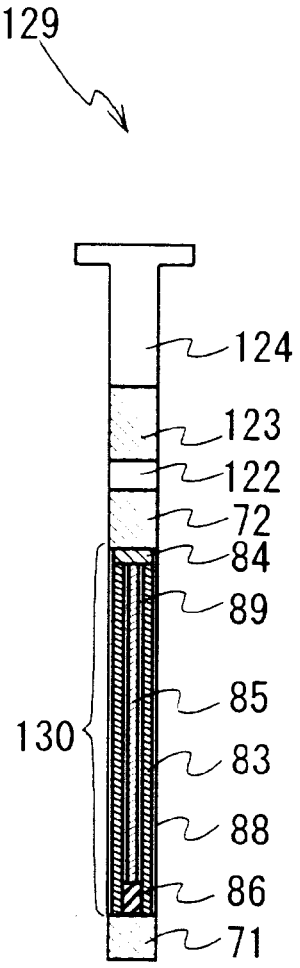
FIGS. 33A and 33B are schematic sectional views showing the configuration of an antenna section of the eighth embodiment.
Figure 33B:
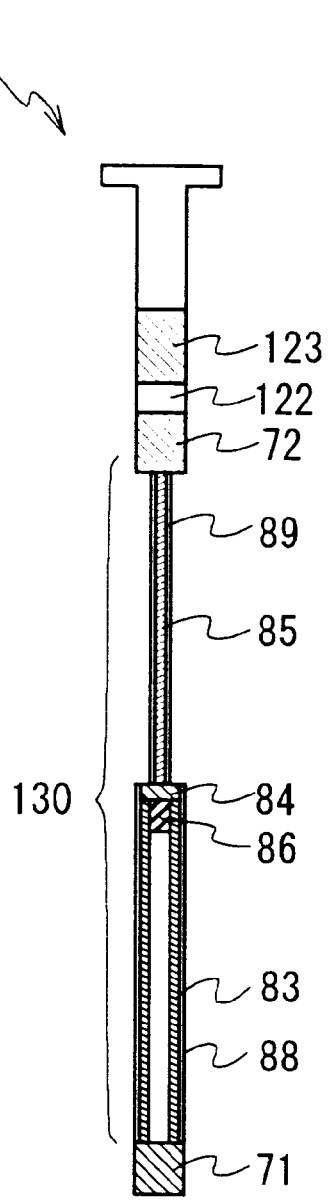

In FIGS. 33A and 33B shown by providing the same symbol for a portion corresponding to that in FIGS. 31A and 31B, and FIGS. 27A and 27B, the antenna section 129 is provided with a retractable rod antenna 130 in which a second antenna half-body 85 is inserted into a first antenna half-body 83 so as to be freely retracted and pulled out.

Moreover, in the antenna device 128 {FIGS. 32A and 32B}, when the rod antenna 130 is retracted and an antenna knob 124 is pushed in the retracted direction and made to contact with the upper face 94A of a helical antenna cover 94, the rod antenna 130 is contracted by pushing the second antenna half-body 85 into the first antenna half-body 83, the contracted rod antenna 130 is stored in the housing 61, and in this case, the antenna member 123 is electrically connected to the helical-antenna power-supply member 125 and top antenna power-supply terminal 126 and a rod-antenna top power-supply member 72 is electrically connected to a bottom antenna power-supply terminal 78.

Thereby, in the antenna device 128, the antenna member 123 is electrically connected to the helical antenna 68 to form a composite antenna and the rod antenna 67 is electrically connected to the balanced of a balun 46 together with the composite antenna.

Moreover, in the antenna device 128, when the rod antenna 130 is pulled out and the antenna knob 124 is pulled in the pull-out direction, the second antenna half-body 85 is pulled out of the first antenna half-body 83 to extend the rod antenna 130 and in this case, the rod-antenna bottom power-supply member 71 is electrically connected to the top antenna power-supply terminal 126.

Thereby, in the cellular telephone 127, it is possible to greatly shorten a portion of the rod antenna 130 to be pushed into the housing 61 compared to the case of the cellular telephone 119 of the seventh embodiment by contracting the rod antenna 130 when the rod antenna 130 is pushed in.

Therefore, in the cellular telephone 127, it is possible to easily set the rod antenna 130 in the housing 61 so as to be freely retracted and pulled out even when the rod antenna 130 is not easily pushed in due to a space occupied by a battery or the like.

Moreover, the cellular telephone 127 makes it possible to secure a comparatively-wide frequency band by operating the rod antenna 130 as an antenna when the rod antenna 130 is both retracted and pulled out.

(10) Ninth Embodiment

Figure 34A:
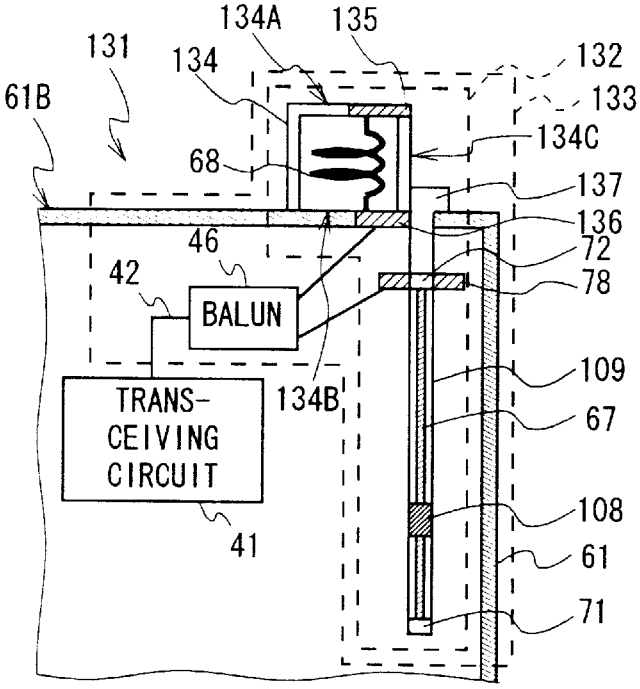
FIGS. 34A and 34B are block diagrams showing the internal configuration of a cellular telephone of the ninth embodiment.
Figure 34B:
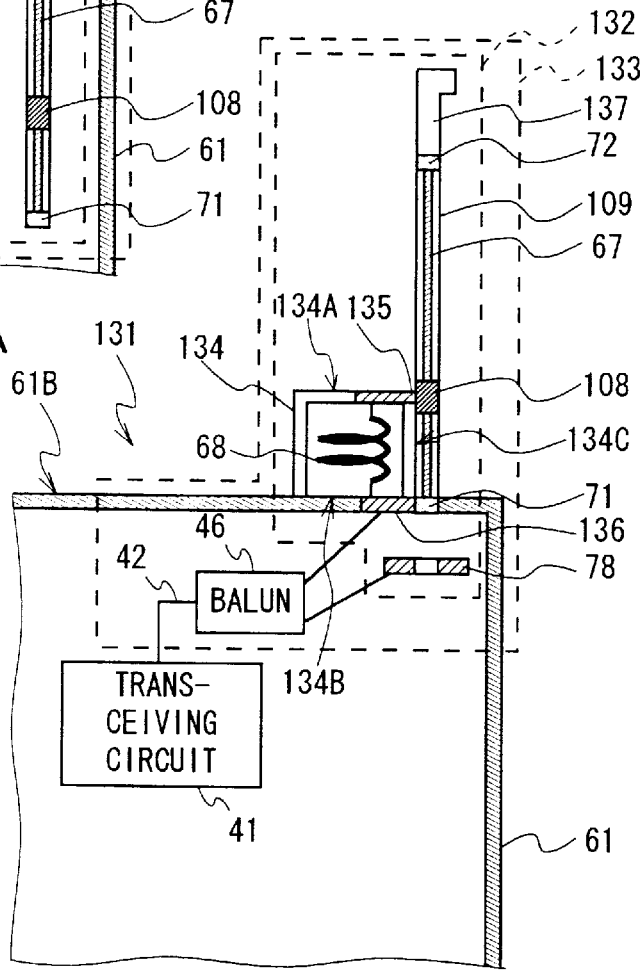

FIGS. 34A and 34B shown by providing the same symbol for a portion corresponding to that in FIGS. 28A and 28B show a cellular telephone 131 of the ninth embodiment, which is configured similarly to the cellular telephone 105 {FIGS. 28A and 28B} of the above-described fifth embodiment except the configuration of an antenna section 133 of an antenna device 132.

In the antenna section 133, a helical antenna cover 134 is provided for the back 61C of the upper face 61A of a housing 61 and a helical short-circuit terminal 135 made of a conductive material and a top antenna power-supply terminal 136 made of a conductive material are set to the upper face 134A and lower face 134B of the helical antenna cover 134 so as to hold a predetermined lateral face (hereafter referred to as antenna sliding face) 134C.

Moreover, a helical antenna 68 is set in the helical antenna cover 134 so that the axis of the helix of the antenna 68 is almost parallel with the longitudinal direction of the housing, the upper end of the helical antenna 68 is electrically connected to the helical short-circuit terminal 135, and the lower end of the helical antenna 68 is electrically connected to the top antenna power-supply terminal 136. In this connection, the top antenna power-supply terminal 136 is also electrically connected to the balanced of the balun 46.

Moreover, in the antenna device 132, the rod antenna 67 is set to the upper face 61A of the housing 61 so that the longitudinal direction of the antenna 67 is almost parallel with the axis of the helix of the helical antenna 68 and slides on the antenna sliding face 134C of the helical antenna cover 134 so that the antenna 67 is pushed in or pulled out.

Moreover, an antenna knob 137 made of a nonconductive material and having an L-shaped cross section is provided for the rod-antenna top power-supply terminal 72 at the upper end of the rod antenna 67.

Thereby, in the antenna device 132, when the rod antenna 67 is retracted and the antenna knob 137 is pushed in the retracting direction and made to contact with the upper face 61A of the housing 61, the rod-antenna top power-supply member 72 is electrically connected to the bottom antenna power-supply terminal 78, and thus the rod antenna 67 is electrically connected to the balanced of the balun 46 together with the helical antenna 68.

Then, in the antenna device 132, when power is supplied to the helical antenna 68 and rod antenna 67 from a transceiving circuit 41 through an unbalanced transmission line 42 and the balun 46 in order under the above state, the helical antenna 68 and rod antenna 67 are operated as almost-balanced antennas and in this case, a leakage current is prevented from flowing to the ground side of the unbalanced transmission line 42 from the rod antenna 67 in accordance with the balanced-to-unbalanced transform by the balun 46 and thus, a shielding case is prevented from operating as an antenna.

In this connection, in the antenna device 132, when the rod antenna 67 is pulled out and the antenna knob 136 is pulled in the pull-out direction, a short-circuit member 108 is electrically connected to the helical short-circuit terminal 135, the rod-antenna bottom power-supply member 71 is electrically connected to the top antenna power-supply terminal 78, and thus upper and lower ends of the helical antenna 68 are short-circuited with the rod antenna 67 to form a composite antenna.

Then, in the antenna device 132, when power is supplied to the composite antenna from the transceiving circuit 41 through the unbalanced transmission line 42 and balun 46 in order under the above state, the helical antenna 68 of the composite antenna does not operate as an antenna because of the short-circuit with the rod antenna 67 so that only the rod antenna 67 is operated as an antenna.

Thereby, the cellular telephone 131 makes it possible to greatly reduce the deterioration of antenna characteristics of the cellular telephone nearby a human body and the power to be absorbed in a human body, that is, the SAR by making a shielding case function only as the original electric shielding plate and ground without operating the shielding case as an antenna when the rod antenna 67 is retracted, similarly to the case of the above-described fifth embodiment.

Moreover, the cellular telephone 131 makes it possible to secure a comparatively-wide frequency band by operating the rod antenna 67 as an antenna when the rod antenna 67 is both retracted and pulled out.

Furthermore, the cellular telephone 131 makes it possible to easily constitute the antenna device 132 without performing complex alignment for inserting the rod antenna 67 into the helical antenna 68 because of setting the axis of the helix of the helical antenna 68 almost in parallel with the longitudinal direction of the rod antenna 67.

(11) Other Embodiment

Figure 35:
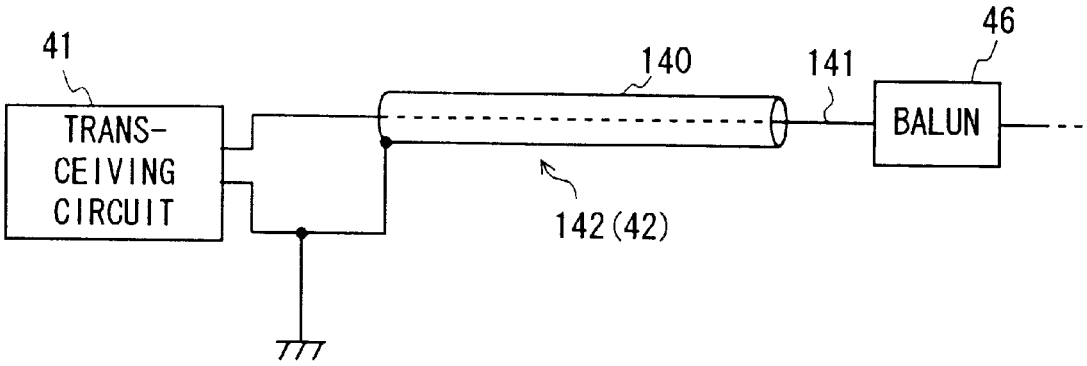
FIG. 35 is a schematic diagram showing the configuration of an unbalanced transmission line of another embodiment configured by a coaxial cable.
Figure 36A:
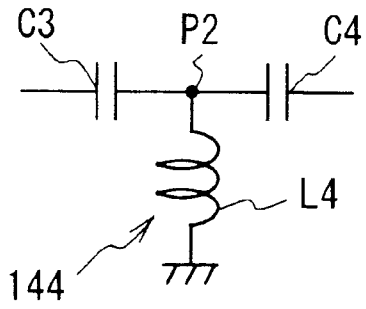
FIGS. 36A to 36C are block diagrams showing the configuration of a phase circuit of another embodiment.
Figure 36B:
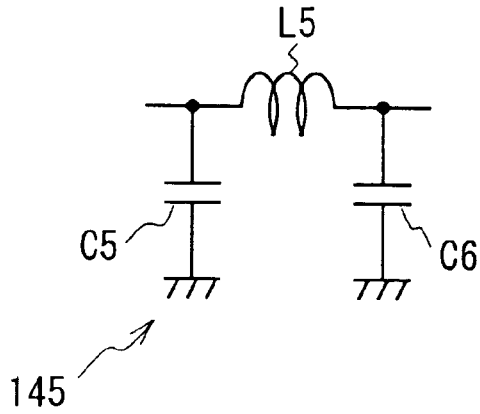
Figure 36C:
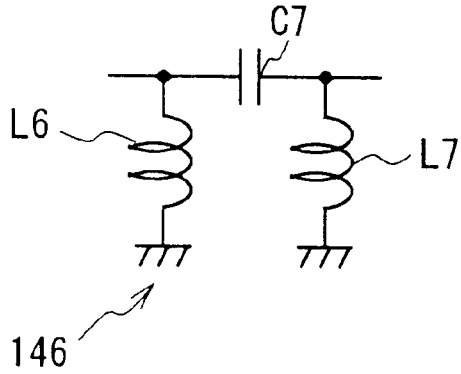

For the above embodiments 1 to 9, a case is described in which the microstrip line 34 shown in FIG. 10 is used as the unbalanced transmission line 42. However, the present invention is not restricted to the above case. It is also possible to apply various unbalanced transmission lines including a coaxial cable 142 formed by insulating a cylindrical external conductor 140 (that is, ground side) from a central conductor 141 (that is, hot side) inserted into the external conductor 140 shown in FIG. 35 to the present invention.

Moreover, for the above embodiments 1 to 9, a case is described in which the phase shifter 49 configured by combining the phase circuits 50 shown in FIG. 14 with the balun 46 shown in FIG. 13 is used. However, the present invention is not restricted to the above case. It is possible to use one of phase shifters having various configurations such as a phase shifter configured by combining a plurality of symmetric-structural T-type phase circuits 144 respectively obtained by connecting two capacitive reactance elements C3 and C4 in series and electrically connecting one end of an inductive reactance element L4 to the connection midpoint P2 between the elements C3 and C4, a phase shifter configured by combining a plurality of symmetric-structural π-type phase circuits 145 respectively obtained by electrically connecting one end of capacitive reactance elements C5 and C6 to both ends of an inductive reactance element L5 and grounding the other ends of the capacitive reactance elements C5 and C6, and a phase shifter configured by combining a plurality of symmetric-structural π-type phase circuits 146 obtained by electrically connecting one end of inductive reactance elements L6 and L7 to both ends of a capacitive reactance element C7 and grounding the other ends of the inductive reactance elements L6 and L7 as long as they can shift a phase of a high-frequency signal up to approximately 180° in a frequency band used.

Furthermore, for the above embodiments 1 to 9, a case is described in which the balun 46 shown in FIG. 13 is used. However, the present invention is not restricted to the above case. It is also possible to use one of baluns having various configurations as long as they can prevent a leakage current from flowing to the ground side of the unbalanced transmission line 42 from an almost-balanced antenna.

Figure 37:
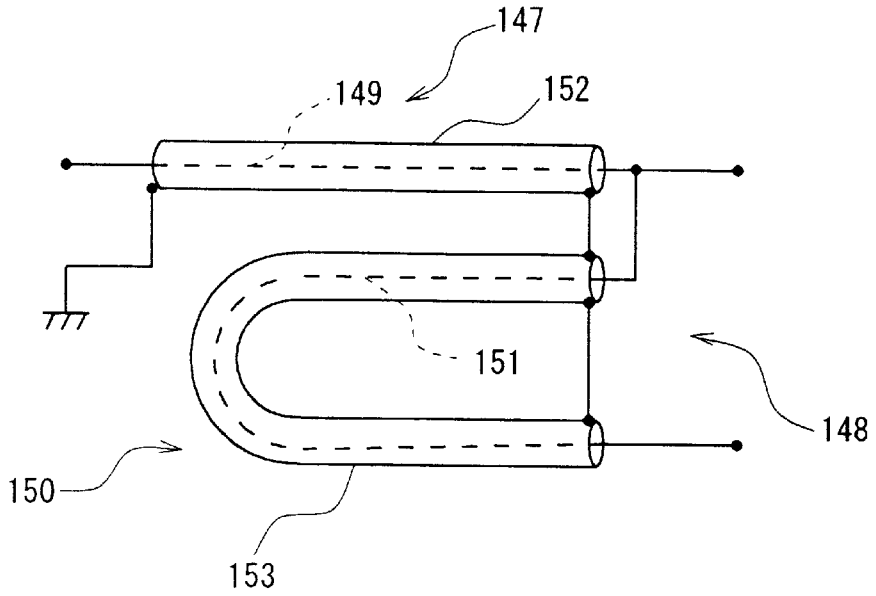
FIG. 37 is a schematic diagram showing the configuration of a balun of another embodiment.

Actually, as one of the baluns of these types, FIG. 37 shows a balun 148 of another configuration using an unbalanced transmission line 147 configured of a coaxial cable, which is configured by electrically connecting one end of the hot side 151 of a coaxial cable (hereafter referred to as bypass line) 150 having an electrical length of ½ wavelength to one end of the hot side of the unbalanced transmission line 147 at a frequency used and moreover, electrically connecting one end of the ground side 153 of the bypass line 150 to one end of the ground side 152 of the unbalanced transmission line 147. That is, the balun 148 of this configuration uses the bypass line 150 having an electrical length of ½ wavelength instead of the phase shifter 49 of the balun 46 in FIG. 13.

In the balun 148 of the above configuration, a first antenna element of an almost-balanced antenna is electrically connected to one end of the hot side 149 of the unbalanced transmission line 147 and a second antenna element of an almost-unbalanced antenna is electrically connected to the other end of the hot side 151 of the bypass line 150, and a high-frequency signal to be transmitted to the first antenna element through the hot side 149 of the unbalanced transmission line 147 is also transmitted to the second antenna element by shifting the phase of the signal to the first antenna element by approximately 180° through the hot side 151 of the bypass line 150, and thereby a leakage current is prevented from flowing to the ground side 152 of the unbalanced transmission line 147 from the second antenna element.

Figure 38:
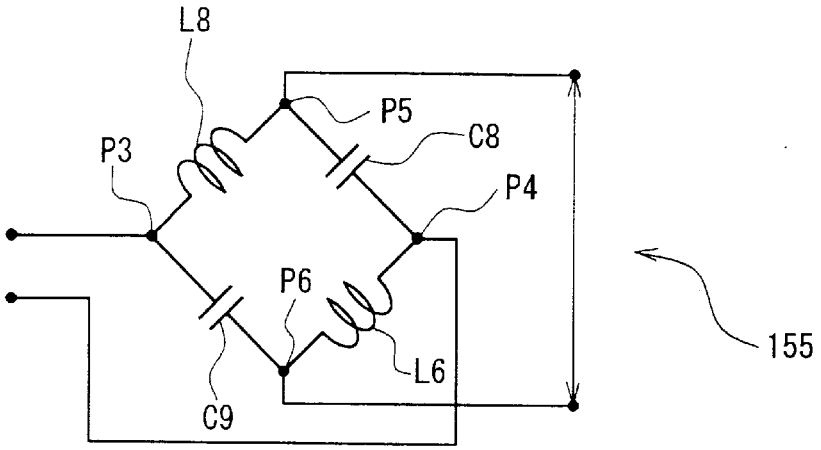
FIG. 38 is a schematic diagram showing the configuration of a balun of another embodiment.

Moreover, as one of these types of baluns, as shown in FIG. 38, there is a balun referred to as so-called LC-bridge balun which is configured by alternately and annularly connecting first and second inductive reactance elements L8 and L6 with first and second capacitive reactance elements C8 and C9 in order, electrically connecting the hot side of a not-illustrated unbalanced transmission line to the connection midpoint P3 between the first inductive reactance element L8 and the second capacitive reactance element C9, electrically connecting the ground side of the unbalanced transmission line to the connection midpoint P4 between the first capacitive reactance element C8 and the second inductive reactance element L6, electrically connecting the first antenna element of a not-illustrated almost-balanced antenna to the connection midpoint P5 between the first inductive reactance element L8 and the first capacitive reactance element C8, and electrically connecting the second antenna element of the almost-balanced antenna to the connection midpoint P6 between the second inductive reactance element L8 and the second capacitive reactance element C8.

In the balun 155 of the above configuration, by equalizing the inductances L of the first and second inductive reactance elements L8 and L6 and the capacitances C of the first and second capacitive reactance elements C7 and C8, and selecting the inductance L and capacitance C so that the inductance L and capacitance C meet the following expressions (1) and (2), a high-frequency signal supplied from the hot side of an unbalanced transmission line is directly transmitted to the first antenna element from the connection midpoint PS, the phase of the high-frequency signal is shifted by approximately 180° from the first antenna element in a frequency band used, and an obtained phase-shifted high-frequency signal is transmitted to the second antenna element from the connection midpoint P6. In the above expressions, Z1 denotes the impedance between the hot side and ground side of an unbalanced transmission line and Z2 denotes the impedance between the midpoints P5 and P6. Moreover, f denotes a frequency used.

$$(2\pi f)^2 LC=1 \quad (1)$$

$$\frac{L}{C} = Z1Z2 \quad (2)$$

Then, the balun 155 having the above configuration can be formed as a microchip of approximately 1 mm square similarly to the case of the phase shifter 49 of the above-described balun 46 shown in FIG. 13. Therefore, it is possible to easily set the balun 155 to a cellular telephone tending to decrease in size and weight.

Figure 39A:
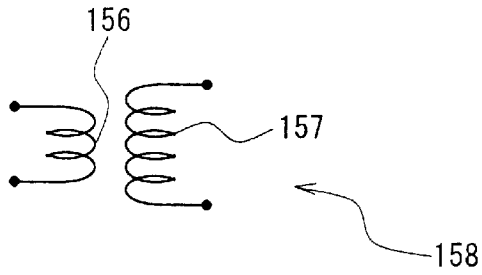
FIGS. 39A and 39B are schematic diagram showing the configuration of a balun of another embodiment.
Figure 39B:
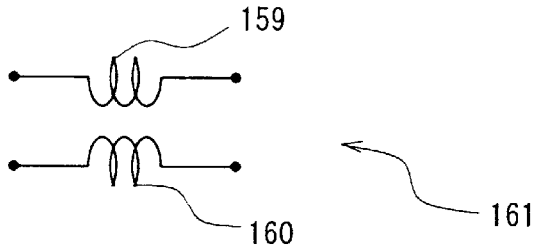

Moreover, as shown in FIGS. 39A and 39B, the balun of this type includes a transformer balun 158 configured by making an air-core coil 157 formed between hot and ground sides and ground side of a not-illustrated unbalanced transmission line face an air-core coil 157 formed between first and second antenna elements of an almost-balanced antenna and a transformer balun 161 configured by making an air-core coil 159 formed between the hot side of an unbalanced transmission line and the first antenna element of an almost-balanced antenna face an air-core coil 160 formed between the ground side of the unbalanced transmission line and the second antenna element of the almost-balanced antenna.

Figure 40:
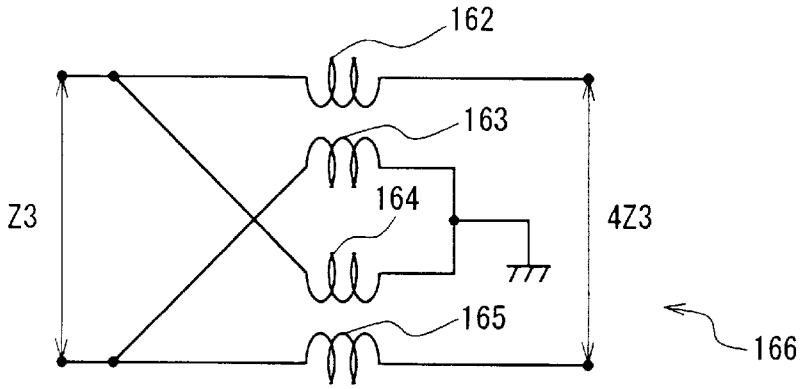
FIG. 40 is a schematic diagram showing the configuration of a balun of another embodiment.

Moreover, as shown in FIG. 40, the balun of the above type includes a transformer balun 166 configured by making an air-core coil 162 formed between the hot side of a not-illustrated unbalanced transmission line and the first antenna element of an almost-balanced antenna face an air-core coil 163 formed between the ground side and the ground of the unbalanced transmission line and making an air-core coil 1634 formed between the ground side of the unbalanced transmission line and the second antenna element of the almost-balanced antenna face an air-core coil 165 formed between the hot side and the ground of the unbalanced transmission line.

In this connection, in the transformer balun 166 having the above configuration, the impedance between connection terminals of the first and second antenna elements is approximately four times (4Z3) larger than the impedance between the hot and ground sides of the unbalanced transmission line.

Figure 41:
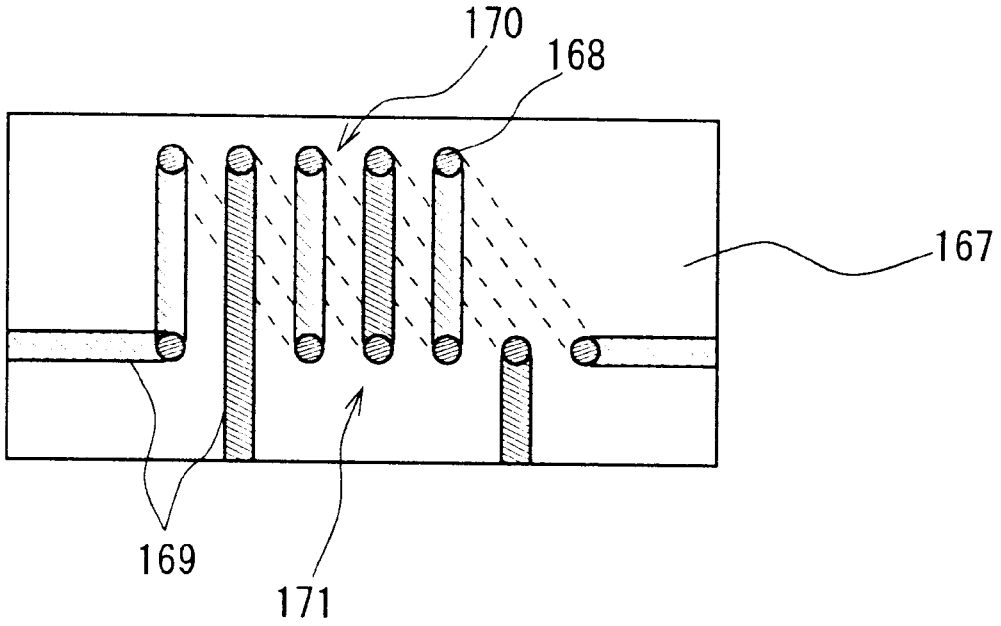
FIG. 41 is a top view showing a coil used for a transformer balun.

Moreover, in the case of the transformer baluns 158, 161, and 166 shown in FIGS. 39A and 39B and FIG. 40, it is possible to use a pair of coils 170 and 171 formed of a through-hole 168 and a conductor pattern 169 for a multi-layer wiring board 167 instead of the air-core coils 156, 157, 159, 160, 162, 163, 164, and 165 as shown in FIG. 41.

Moreover, by using a coil formed by integrating a conductor pattern, the transformer baluns 158, 161, and 166 can be respectively formed of a microchip of approximately 1 to 3 mm square. Therefore, it is possible to easily set the microchip even when an arrangement space is limited similarly to the case of the above-described LC bridge balun 155 (FIG. 38).

Figure 42A:
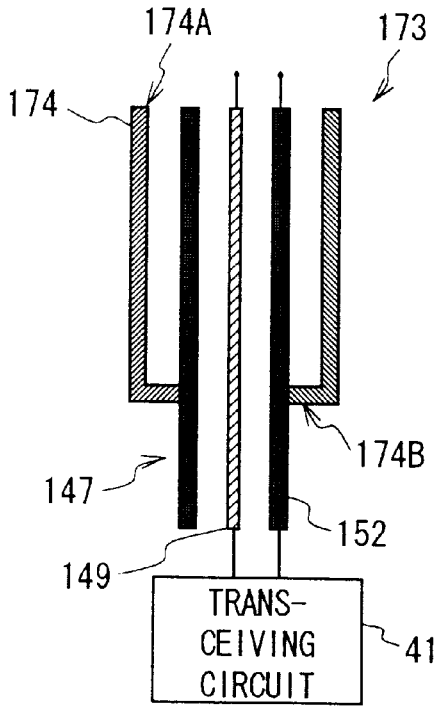
FIGS. 42A and 42B are a schematic sectional view and a schematic diagram showing the configuration of a Sperrtopf balun of another embodiment using a coaxial cable.
Figure 42B:
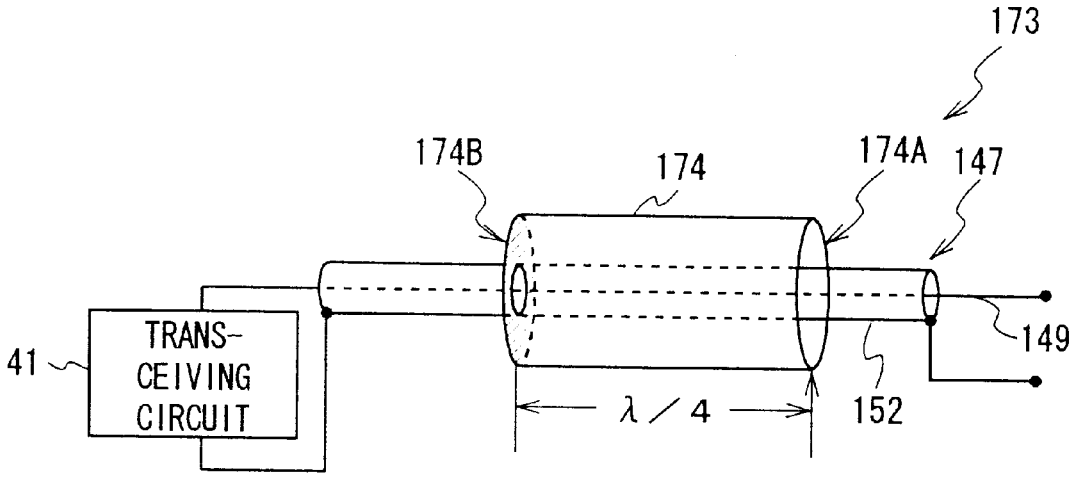

Furthermore, as one of the baluns of the above type, FIGS. 42A and 42B show a balun 173 of another configuration using the unbalanced transmission line L47 configured of a coaxial cable, which is referred to as the so-called Sperrtopf balun or Bazooka balun in which the unbalanced transmission line 147 is inserted into a cylindrical conductor 174, one end 174A of the cylindrical conductor 174 is opened, and the other end 174B of it is short-circuited with the ground side 152 of the unbalanced transmission line 147.

In the balun 173 having the above configuration, the first antenna element of the almost-balanced antenna is electrically connected to the hot side 149 of the unbalanced transmission line 147 at the open side (balanced side) of the cylindrical conductor 174, the second antenna element of the almost-balanced antenna is electrically connected to the ground side 152 of the unbalanced transmission line 147, and the transceiving circuit 41 is electrically connected to the hot side 149 and ground side 152 of the unbalanced transmission line 147 at the short-circuited side (unbalanced side) of the cylindrical conductor 174.

Moreover, in the balun 173, the unbalanced transmission line 147 can be regarded as a transmission line having an electrical length of ¼ wavelength in which as a whole, the line 147 serves as an internal conductor, the cylindrical conductor 174 serves as an external conductor, and either of them is contracted at the time of viewing the unbalanced side from the balanced side because the frequency used by the cylindrical conductor 174 is selected as an electrical length of ¼ wavelength and the impedance becomes infinite to a leakage current. Therefore, it is possible to prevent a leakage current from flowing to the ground side 152 of the unbalanced transmission line 147.

Figure 43:
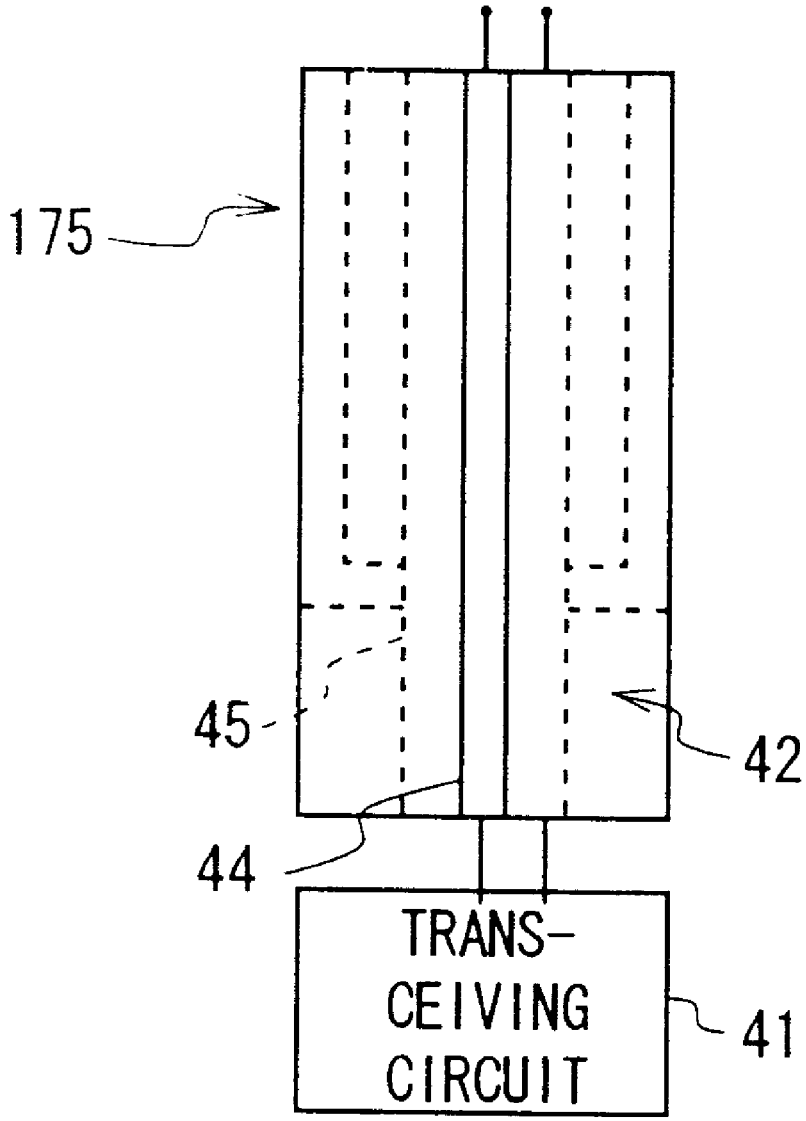
FIG. 43 is a schematic diagram showing the configuration of a Sperrtopf balun of another embodiment using a microstrip line.

In this connection, FIG. 43 shows a Sperrtopf balun 175 using the unbalanced transmission line 42 configured of a microstrip line, which becomes equivalent to the Sperrtopf balun 173 shown in FIGS. 42A and 42B and operates similarly to the balun 173 by assuming the hot side 44 as the central conductor of a coaxial cable and thereby forming it into a line and forming the ground side 45 into a shape like the cross section of external conductor and cylindrical conductor of the coaxial cable.

Figure 44:
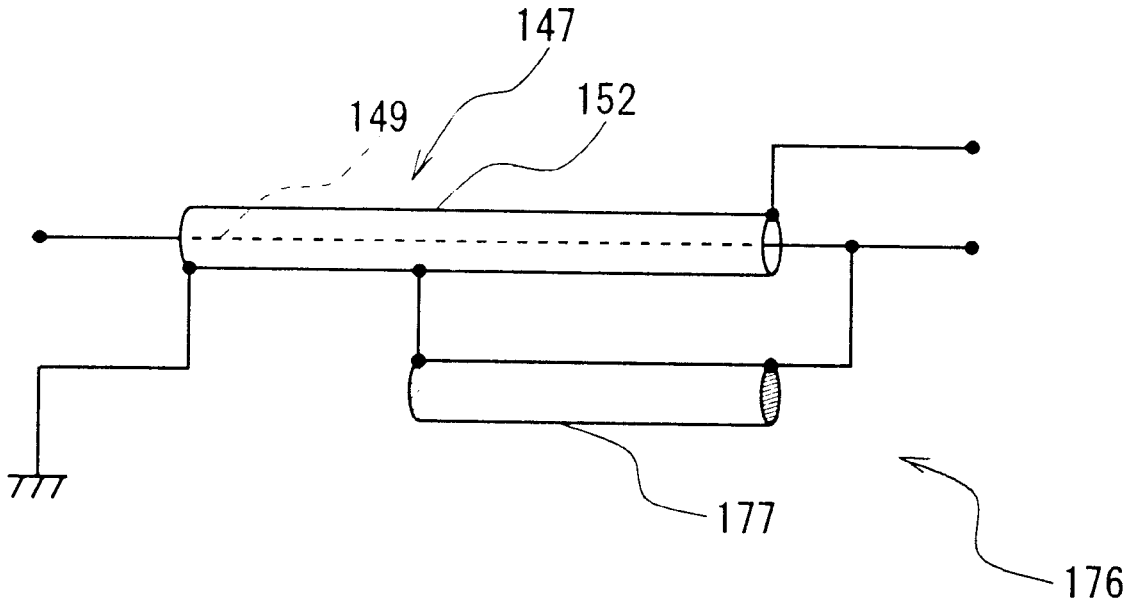
FIG. 44 is a schematic diagram showing the configuration of a balun of another embodiment.

Moreover, as the balun of the above type, FIG. 44 shows a balun 176 of another configuration using the unbalanced transmission line 147 configured of a coaxial cable, which is configured by arranging the unbalanced transmission line 147 and a conductor (hereafter referred to as branch conductor) 177 having an electrical length of ¼ wavelength while putting the other ends of the line 147 and the conductor in order and electrically connecting one end of the branch conductor 177 to the hot side 149 of the unbalanced transmission line 147 and the other end of the conductor 177 to a portion facing the ground side 152 of the unbalanced transmission line 147.

In case of the balun 176 having the above configuration, a first antenna element is electrically connected to the other end of the hot side 149 of the unbalanced transmission line 147 and a second antenna element is electrically connected to the other end of the ground side 152 of the unbalanced transmission line 147. Thereby, the balun 176 serves as a circuit equivalent to the baluns 173 and 175 shown in FIGS. 42A and 42B and FIG. 43 and prevents a leakage current by making the impedance of the other end of the hot side 149 of the unbalanced transmission line 147 infinite similarly to the case of the baluns 173 and 175.

Figure 45A:
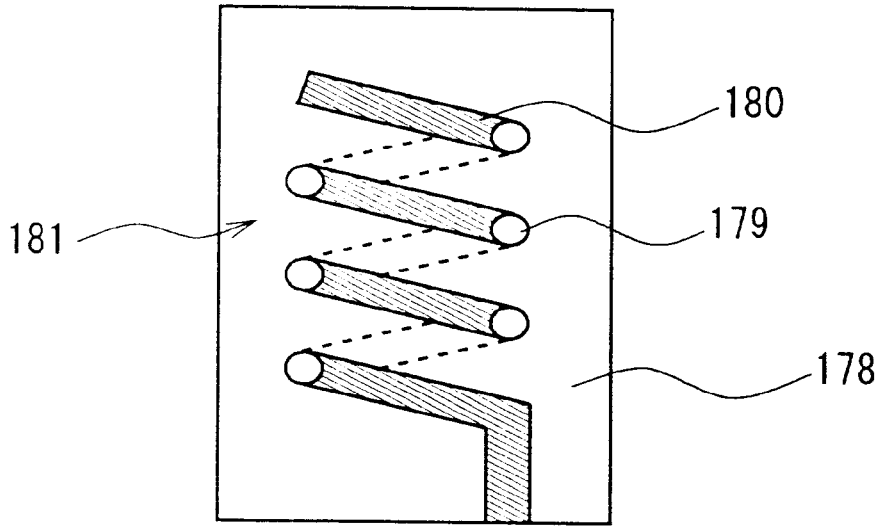
FIGS. 45A and 45B are schematic top views showing the configuration of antenna element of another embodiment substituted for first and second helical antennas.
Figure 45B:
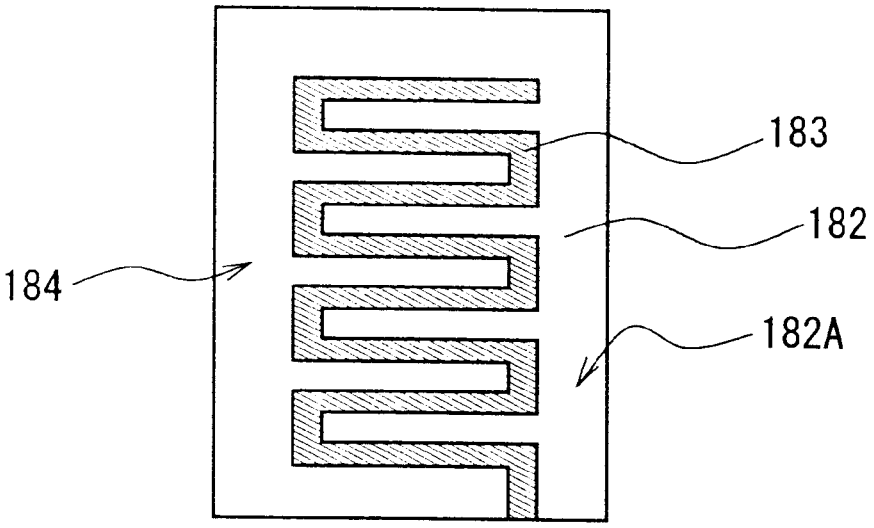

Moreover, for the above-described embodiments 1 to 9, a case is described in which the helical antenna 68 formed by helically winding a conductive wire is used. However, the present invention is not restricted to the above case. As shown in FIGS. 45A and 45B, it is permitted to use one of various antenna elements including a helical antenna 181 obtained by forming a through-hole 179 and a conductor pattern 180 on a multilayer wiring board 178 and an antenna element 184 configured by meanderingly forming a conductor pattern 183 on one face 182A of a circuit board 182.

Figure 46A:
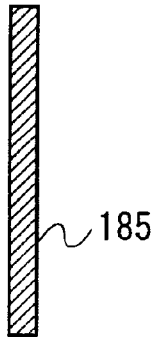
FIGS. 46A to 46C are schematic top views showing the configuration of an antenna element of another embodiment.
Figure 46B:
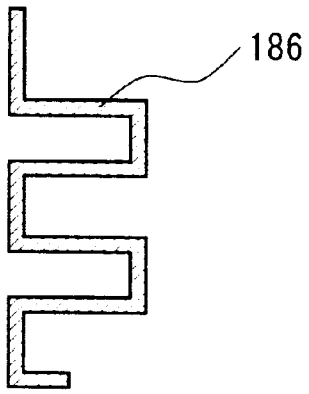
Figure 46C:
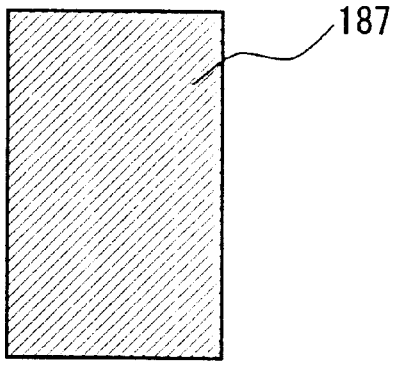

Moreover, as shown in FIGS. 46A to 46C, instead of the helical antenna it is possible to use a thin antenna element such as an antenna element 185 obtained by linearly forming a conductive thin plate, an antenna element 186 meanderingly formed of a conductive thin plate, or an antenna element 187 formed of a conductive thin plate into a quadrangle for the inside or outside of the housing 61. By using the above antenna element, it is possible to prevent the housing 61 from increasing in size.

Figure 47:
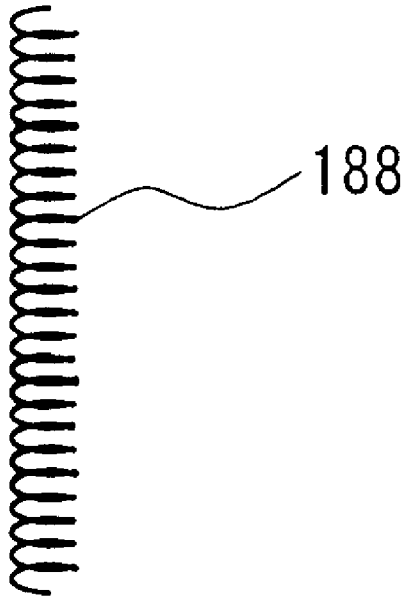
FIG. 47 is a schematic diagram showing the configuration of an antenna element substituted for rod antenna.

Furthermore, for the above first, third, fifth, seventh, and ninth embodiments, a case is described in which the rod antenna 67 made of a conductive rod wire is used. However, the present invention is not restricted to the above case. As shown in FIG. 47, it is possible to use one of various antenna elements such as a densely-wound coil 188 formed by helically winding a conductive wire to serve as an electrical cylindrical conductor and an antenna element formed of a predetermined conductor on a circuit board. In this connection, by using the densely-wound coil 188 as an antenna element, it is possible to prevent the coil 188 from damaging even if it is bent when pulled out of the housing 61.

In this connection, the densely-wound coil 188 can be also used as the first antenna half-body 83 of the above second and fourth embodiments and sixth and eighth embodiments. By using the coil 188 as the first antenna half-body 83, it is possible to prevent the coil 188 from damaging even if it is bent at the time of pulling it out of the housing 61 similarly to the case described above.

Moreover, for the above second, fourth, and eighth embodiments, a case is described in which the antenna sections 82, 102, and 129 provided with the retractable rod antennas 90, 103, and 130 shown in FIGS. 23A and 23B, FIGS. 27A and 27B and FIGS. 33A and 33B are used. However, the present invention is not restricted to the above case. It is also permitted to use an antenna section 191 provided with a retractable rod antenna 190 configured as shown in FIGS. 48A and 48B shown by providing the same symbol for a portion corresponding to that in FIGS. 23A and 23B, an antenna section 193 provided with a retractable rod antenna 192 configured as shown in FIGS. 49A and 49B shown by providing the same symbol for a portion corresponding to that in FIGS. 27A and 27B, or an antenna section 195 provided with a retractable rod antenna 194 configured as shown in FIGS. 50A and 50B shown by providing the same symbol for a portion corresponding to that in FIGS. 33A and 33B.

Figure 48A:
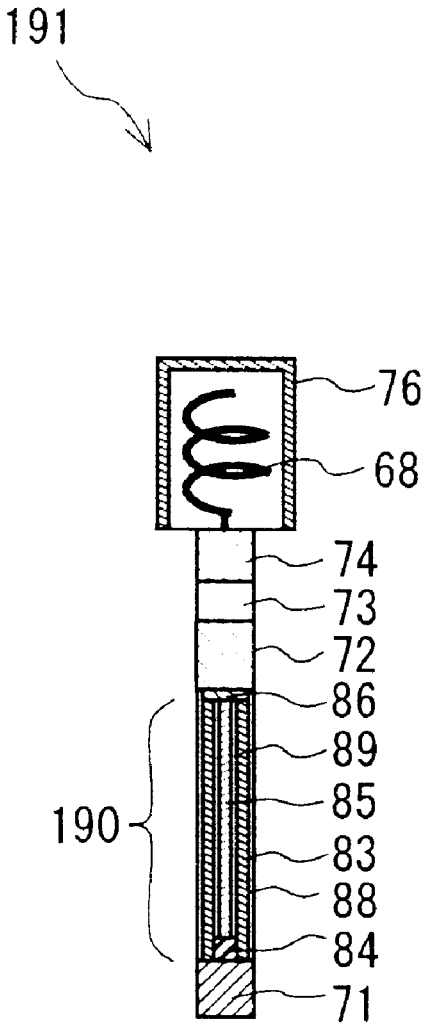
FIGS. 48A and 48B are schematic sectional views showing the configuration of an antenna section provided with a retractable rod antenna of another embodiment.
Figure 48B:
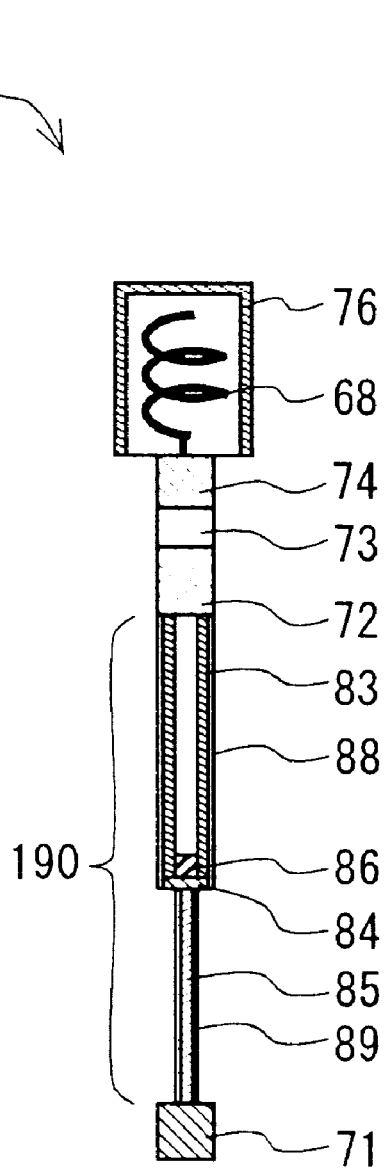

Actually, in the antenna section 191 shown in FIGS. 48A and 48B, the rod-antenna bottom power-supply member 71 is electrically and mechanically connected to the lower end of the second antenna half-body 85 and the upper end of the half-body 85 is inserted into the hole of the first antenna half-body 83 and electrically and mechanically connected to the sliding spring 86. Moreover, the lower end of the first antenna half-body 83 is provided with the pull-out stop section 84 and the rod-antenna top power-supply member 72 is electrically and mechanically connected to the upper end of the half-body 83. Thereby, in the antenna section 191, the retractable rod antenna 190 is formed of the first and second antenna half-bodies 83 and 85 similarly to the case of the antenna section 82 of the above second embodiment.

Figure 49A:
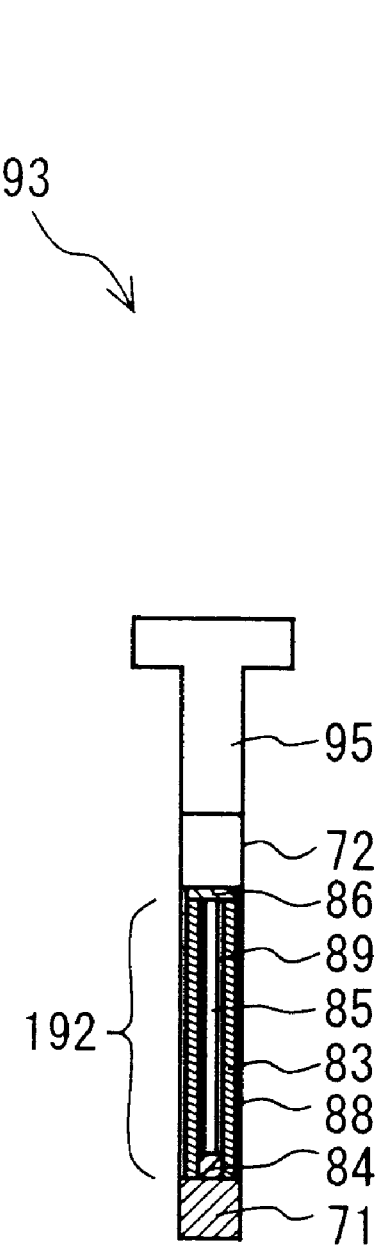
FIGS. 49A and 49B are schematic sectional views showing the configuration of an antenna section of another embodiment provided with a retractable rod antenna.
Figure 49B:
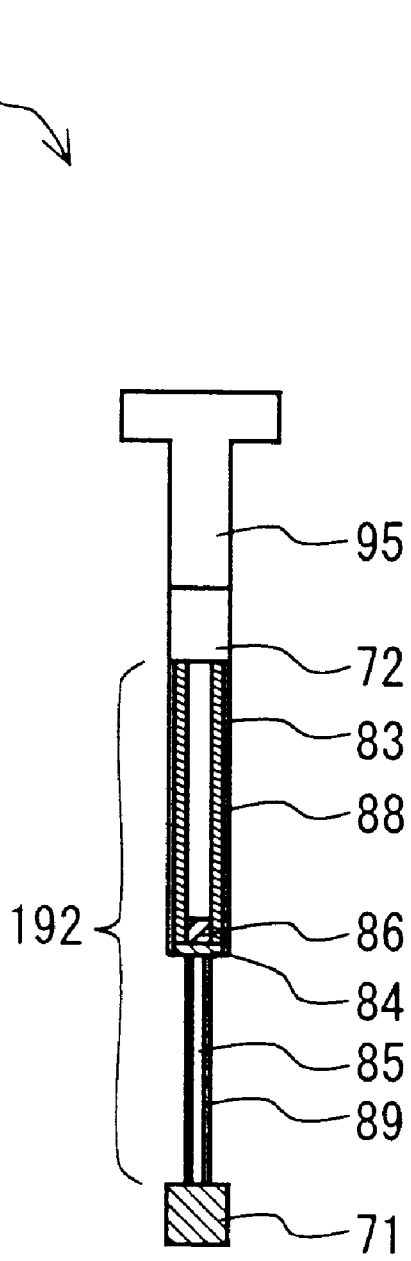

Moreover, in the antenna section 193 shown in FIGS. 49A and 49B, the rod-antenna bottom power-supply member 71 is electrically and mechanically connected to the lower end of the antenna half-body 85 and the upper end of the half-body 85 is inserted into the hole of the first antenna half-body 83 and electrically and mechanically connected to the sliding spring 86. Furthermore, the pull-out stop section 84 is provided for the lower end of the first antenna half-body 83 and the rod-antenna top power-supply member 72 is electrically and mechanically connected to the upper end of the half-body 83. Thereby, also in the antenna section 193, the retractable rod antenna 192 is formed of the first and second antenna half-bodies 83 and 84 similarly to the case of the above fourth embodiment.

Figure 50A:
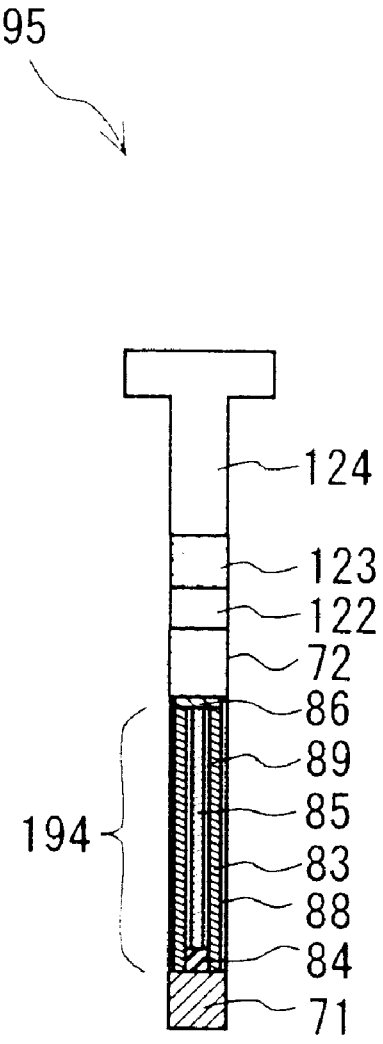
FIGS. 50A and 50B are schematic sectional views showing the configuration of an antenna section of another embodiment provided with a retractable rod antenna.
Figure 50B:
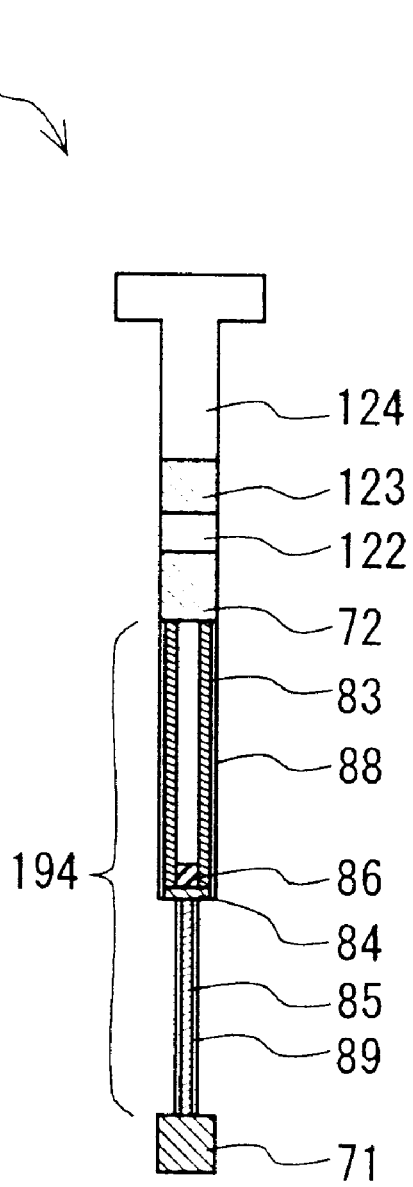

Furthermore, in the antenna section 195 shown in FIGS. 50A and 50B, the rod-antenna bottom power-supply member 71 is electrically and mechanically connected to the lower end of the second antenna half-body 85 and the upper end of the half-body 85 is inserted into the hole of the first antenna half-body 83 and electrically and mechanically connected to the sliding spring 86. Moreover, the lower end of the first antenna half-body 83 is provided with the pull-out stop section 84 and the rod-antenna top power-supply member 72 is electrically and mechanically connected to the upper end of the half-body 83. Thereby, also in the antenna section 195, the retractable rod antenna 194 is formed of the first and second antenna half-bodies 83 and 84 similarly to the case of the above eighth embodiment.

Figure 51A:
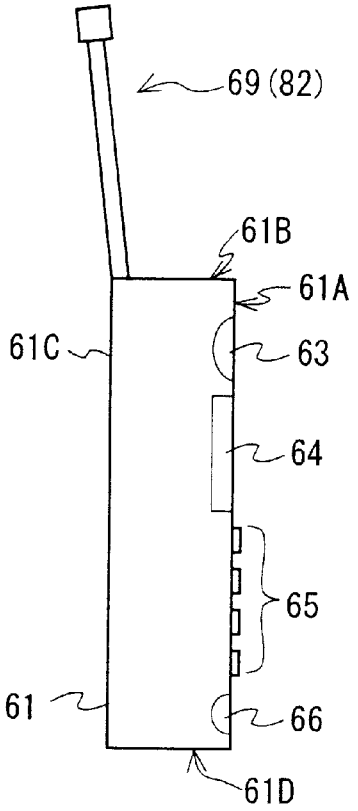
FIGS. 51A and 51B are schematic side views for explaining push-in and pull-out directions of an antenna section of another embodiment.
Figure 51B:
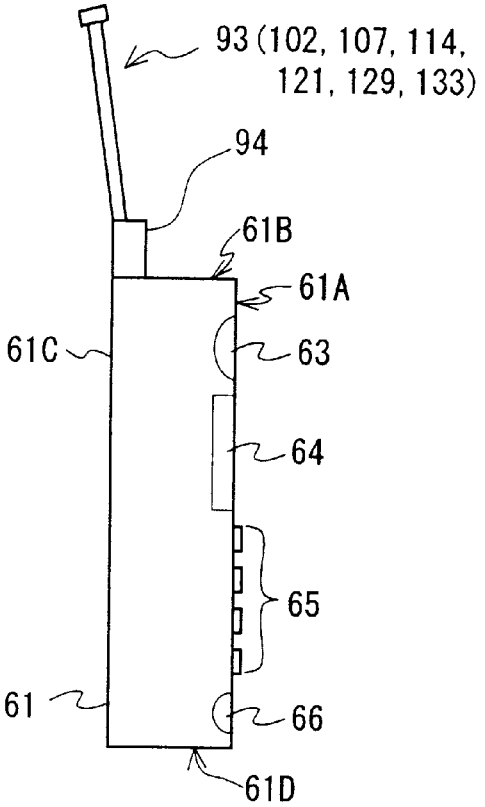

Furthermore, for the above first to ninth embodiments, a case is described in which the antenna sections 62, 82, 93, 102, 107, 114, 121, 129, and 133 are set so as to be freely retracted and pulled out along the longitudinal direction of a housing. However, the present invention is not restricted to the above case. For example, it is also permitted to set the antenna sections 62, 82, 93, 102, 107, 114, 121, 129, and 133 so as to be freely retracted and pulled out along the a direction tilted from the longitudinal direction of the housing 61 at the front 61A of the lower face 61D of the housing 61 from the back 61C side of the upper face 61B of the housing 61 as shown in FIG. 51 shown by providing the same symbol for a portion corresponding to that in FIGS. 20 and 24.

Thereby, it is possible to separate the antenna sections 62, 82, 93, 102, 107, 114, 121, 129, and 133 from the head of a user even if a cellular telephone is approached to the head of the user at the time of pulling out the antenna sections 62, 82, 93, 102, 107, 114, 121, 129, and 133. Thus, it is possible to further reduce the deterioration of antenna characteristics of the cellular telephone nearby a human body.

Figure 52:
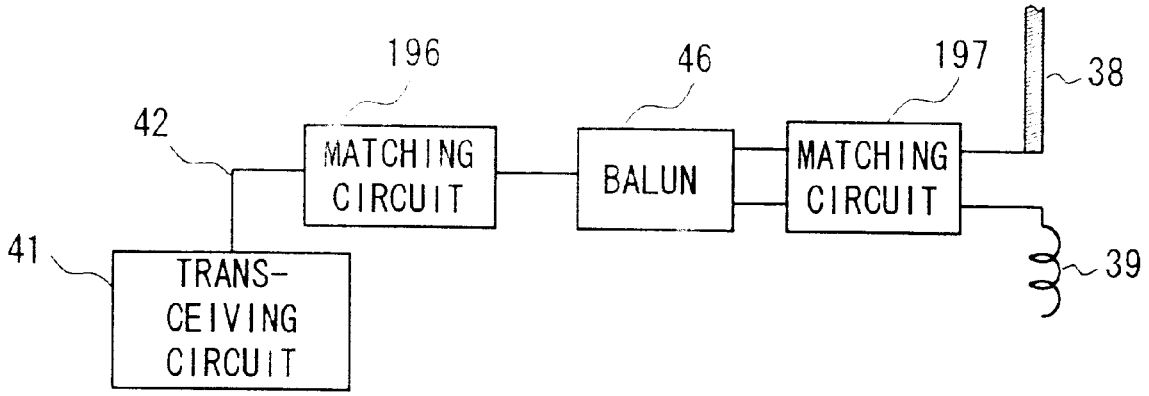
FIG. 52 is a block diagram for explaining the arrangement of matching circuits of another embodiment.

Moreover, for the above first to ninth embodiments, a case is described in which a matching circuit is set between the transceiving circuit 41 and the balun 46 or between the balun 46 on one hand and the first and second antenna elements on the other as described for theory. However, the present invention is not restricted to the above case. As shown in FIG. 52, it is also permitted to set the matching circuits 196 and 197 to the balanced and unbalanced sides of the balun 46.

Furthermore, for the above first to ninth embodiments, a case is described in which a leakage current is prevented from flowing to the ground side of the unbalanced transmission line 42 from the second antenna elements in accordance with the balanced-to-unbalanced transform by the balun 46. However, the present invention is not restricted to the above case. It is also permitted to prevent a leakage current from flowing to the ground side of the unbalanced transmission line 42 from the first antenna element in accordance with the balanced-to-unbalanced transform by the balun 46 by changing connections of the first and second antenna elements to the balanced-side terminal of the balun 46.

Furthermore, for the above first to ninth embodiments, a case is described in which the present invention is applied to the above cellular telephones 60, 80, 91, 100, 105, 112, 119, 127, and 131. However, the present invention is not restricted to the above case. It is also possible to widely apply the present invention to various portable radio sets including a cordless handset of a cordless telephone.

Furthermore, for the above first to ninth embodiments, a case is described in which the balun 46 is used as balanced-to-unbalanced transform means for applying balanced-to-unbalanced transform between an unbalanced transmission line on one hand and first and second antenna elements on the other. However, the present invention is not restricted to the above case. As long as balanced-to-unbalanced transform can be applied between first and second antenna elements, various balanced-to-unbalanced transform means can be widely used including the above various baluns.

Furthermore, for the above first to ninth embodiments, a case is described in which the rod-antenna bottom power-supply member 71, rod-antenna top power-supply member 72, helical-antenna power-supply members 74 and 125, top antenna power-supply terminals 77 and 136, bottom antenna power-supply terminal 78, and antenna member 123 are used as connection means for electrically connecting first and second antenna elements to a balanced-to-unbalanced transform circuit when the first antenna element is retracted and electrically connecting at least first antenna element to the balanced-to-unbalanced transform circuit when the first antenna element is pulled out. However, the present invention is not restricted to the above case. Other various connection means can be also used as long as they can electrically connect first and second antenna elements to a balanced-to-unbalanced transform circuit when the first antenna element is pushed in and at least first antenna element to the balanced-to-unbalanced transform circuit when the first antenna element is pulled out.

While there has been described in connection with the preferred embodiments of the invention, it will be obvious to those skilled in the art that various changes and modifications may be aimed, therefore, to cover in the appended claims all such changes and modifications as fall within the true spirit and scope of the invention.

What is claimed is:

1. An antenna device comprising:

a first antenna element provided so as to be freely retracted or extended;

a second antenna element;

an unbalanced transmission line for supplying power to the first and second antenna elements;

balanced-to-unbalanced transform means for performing balanced-to-unbalanced transform between the unbalanced transmission line and the first and second antenna elements; and connection means for electrically connecting the first and second antenna elements to the balanced-to-unbalanced transform means when the first antenna element is retracted and electrically connecting at least the first antenna element to the balanced-to-unbalanced transform means when the first antenna element is extended, wherein the first and second antenna elements are operated as antennas by supplying power to the first and second antenna elements from the unbalanced transmission line through the balanced-to-unbalanced transform means when the first antenna element is retracted; and the first antenna element is operated as an antenna by supplying power to at least the first antenna element from the unbalanced transmission line through the balanced-to-unbalanced transform means when the first antenna element is extended.

2. The antenna device according to claim 1, wherein the first antenna element is configured as a rod antenna; and the second antenna element is configured as a helical antenna mechanically connected to the rod antenna.

3. The antenna device according to claim 2, wherein the rod antenna is formed as a collapsible antenna by inserting a conductive rod member into a conductive hollow cylinder and the rod antenna is collapsed when the rod antenna is retracted.

4. The antenna device according to claim 1, wherein the first antenna element is configured as a rod antenna; and the second antenna element is configured as a helically-formed fixed helical antenna and positioned so that the rod antenna is retracted and extended along the helical axis of the helical antenna.

5. The antenna device according to claim 1, wherein the first antenna element is configured as a rod antenna; and the second antenna element is configured as a helically-formed fixed helical antenna and positioned so that the helical axis of the helical antenna is almost parallel to the longitudinal direction of the rod antenna.

6. The antenna device according to claim 1, wherein the first antenna element is configured as a rod antenna; and the second antenna element is configured as a helically-formed fixed helical antenna, having one or both ends electrically connected to the rod antenna to form a composite antenna when the first antenna element is extended.

7. A portable radio set having an antenna device, the antenna device comprising:

a first antenna element provided so as to be freely retracted and extended;

a second antenna element;

an unbalanced transmission line for supplying power to the first and second antenna elements;

balanced-to-unbalanced transform means for performing balanced-to-unbalanced transform between the unbalanced transmission line and the first and second antenna elements; and connection means for electrically connecting the first and second antenna elements to the balanced-to-unbalanced transform means when the first antenna element is retracted and electrically connecting at least the first antenna element tot he balanced-to-unbalanced transform means when the first antenna element is extended, wherein the first and second antenna elements are operated as antennas by supplying power to the first and second antenna elements from the unbalanced transmission line through he balanced-to-unbalanced transform means when the first antenna element is retracted; and the first antenna element is operated as an antenna by supplying power to at least the first antenna element from the unbalanced transmission line through the balanced-to-unbalanced transform means when the first antenna element is extended.

8. The portable radio set according to claim 7, wherein the first antenna element is configured as a rod antenna; and the second antenna element is configured as a helical antenna mechanically connected to the rod antenna.

9. The por table radio set according to claim 8, wherein the rod antenna is formed as a collapsible an tenna by inserting a conductive rod member into a conductive hollow cylinder and the rod antenna is collapsed when the rod antenna is retracted.

10. The portable radio set according to claim 7, wherein the first antenna element is configured as a rod antenna; and the second antenna element is configured ed as a helically-formed fixed helical antenna and positioned so that the rod antenna is retracted and extended along the helical axis of the helical antenna.

11. The portable radio set according to claim 7, wherein the first antenna element is configured as a rod antenna; and the second antenna element is configured as a helically-formed fixed helical antenna, and positioned so that the helical axis of the helical antenna is almost parallel to the longitudinal direction of the rod antenna.

12. The portable radio set according to claim 7, wherein the first antenna element is configured as a rod antenna; and the second antenna element is configured as a helically-formed fixed helical antenna, having one or both ends electrically connected to the rod antenna to form a composite antenna when the first antenna element is extended.

* * * * *